US009291938B2

(12) United States Patent
Maeyama et al.

(10) Patent No.: US 9,291,938 B2
(45) Date of Patent: Mar. 22, 2016

(54) WET-TYPE IMAGE FORMATION APPARATUS

(71) Applicant: Konica Minolta, Inc., Chiyoda-ku (JP)

(72) Inventors: Takeshi Maeyama, Ikeda (JP); Atsuto Hirai, Ikoma (JP); Yuuya Sato, Settsu (JP); Makiko Watanabe, Uji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 14 days.

(21) Appl. No.: 14/483,817

(22) Filed: Sep. 11, 2014

(65) Prior Publication Data

US 2015/0078773 A1 Mar. 19, 2015

(30) Foreign Application Priority Data

Sep. 13, 2013 (JP) ..... 2013-190560

(51) Int. Cl.

| | |
|---|---|
| ***G03G 15/06*** | (2006.01) |
| ***G03G 15/10*** | (2006.01) |
| ***G03G 15/00*** | (2006.01) |

(52) U.S. Cl.

CPC ..... *G03G 15/065* (2013.01); *G03G 15/10* (2013.01); *G03G 15/5041* (2013.01)

(58) Field of Classification Search

CPC .... G03G 15/065; G03G 15/10; G03G 15/105
See application file for complete search history.

(56) References Cited

U.S. PATENT DOCUMENTS

| | | | | |
|---|---|---|---|---|
| 2010/0226674 | A1 | 9/2010 | Fukazawa | |
| 2010/0226687 | A1 | 9/2010 | Fukazawa | |
| 2013/0101304 | A1 | 4/2013 | Sasaki et al. | |
| 2015/0071664 | A1 * | 3/2015 | Hirai ..... | G03G 15/5058 399/53 |

FOREIGN PATENT DOCUMENTS

| | | | |
|---|---|---|---|
| JP | 2004-117846 | A | 4/2004 |
| JP | 2009-015351 | A | 1/2009 |
| JP | 2010-204468 | A | 9/2010 |
| JP | 2010-204469 | A | 9/2010 |
| JP | 2013-092602 | A | 5/2013 |

OTHER PUBLICATIONS

Office Action (Notice of Grounds of Rejection) issued on Aug. 25, 2015, by the Japanese Patent Office in corresponding Japanese Patent Application No. 2013-190560, and an English translation of the Office Action. (7 pages).

* cited by examiner

*Primary Examiner* — Rodney Bonnette
(74) *Attorney, Agent, or Firm* — Buchanan Ingersoll & Rooney PC

(57) ABSTRACT

When a toner charging amount for toner in a liquid developer conveyed to a development portion is set, a wet-type image formation apparatus performs a sensing operation in which a sensing unit senses image densities of a plurality of patch images formed at different development biases with the toner charging amount being set to a constant value, and a setting operation in which, in a case where a control unit calculates current development characteristics based on the image densities of the plurality of patch images sensed by the sensing unit, and determines that the current development characteristics are not included within a set target range, the control unit controls a charging unit to set the toner charging amount such that the development characteristics are included within the set target range.

9 Claims, 10 Drawing Sheets

FIG.15

WET-TYPE IMAGE FORMATION APPARATUS

This application is based on Japanese Patent Application No. 2013-190560 filed with the Japan Patent Office on Sep. 13, 2013, the entire content of which is hereby incorporated by reference.

BACKGROUND OF THE INVENTION

1. Field of the Invention

The present invention relates to a wet-type image formation apparatus, and in particular to a wet-type image formation apparatus controlling image formation conditions based on the image density of a patch image.

2. Description of the Related Art

An image formation apparatus adopting a wet-type electrophotographic method (hereinafter also referred to as a wet-type image formation apparatus) can form high quality images, because it uses toner with a smaller diameter than that in a dry-type electrophotographic method. As disclosed in Japanese Lain-Open Patent Publication Nos. 2010-204468 and 2010-204469, an ordinary wet-type image formation apparatus includes a control unit for setting image formation conditions to an optimal state. By setting the image formation conditions to the optimal state, occurrence of image noise (such as rivulets, rear edge shift, and deterioration of dot reproduction) can be suppressed, and high quality images can be formed.

One of the means for suppressing occurrence of image noise is to set a charging amount for toner in a liquid developer conveyed to a development portion to a value that is as high as possible. The toner having a high charging amount is rarely influenced by the movement of a carrier liquid, and can form a toner image that is faithfully in line with the shape of an electrostatic latent image. On the other hand, when the toner charging amount is set to be higher than necessary, development characteristics have a too small gradient. In this case, the amount of toner used for development in a limited development potential difference is decreased, and development efficiency is reduced.

When the type of a recording medium (printing object) is changed or the like, the target range of a conveying amount of the liquid developer (toner) conveyed to the development portion by a developer carrier is also changed. When the toner conveying amount is changed to be increased, the toner charging amount is set low. With this setting, the development characteristics have a large gradient, which can suppress a decrease in the amount of toner used for development in a limited development potential difference, that is, a reduction in development efficiency.

When the toner conveying amount is changed to be decreased, the toner charging amount is set high. Even if the toner charging amount is not changed, a decrease in the amount of toner used for development, that is, a reduction in development efficiency can be suppressed. However, when the toner charging amount is not changed, there is room for further decrease in the gradient of an inclined portion of the development characteristics. To improve image quality, it is desirable to set the toner charging amount high.

Irrespective of whether or not the target range of the toner conveying amount is changed, it is desirable to set the toner charging amount as high as possible. The conveying amount of the toner in the liquid developer, the viscosity of the liquid developer, toner particle size distribution, and the like tend to vary depending on individual differences in manufacturing and a change in an ambient environment of the apparatus.

These parameters influence a toner conveying amount which allows implementation of high quality image formation. Therefore, it is desirable to set a maximum value within a range in which high quality image formation can be implemented in an environment where the apparatus is placed, as the toner charging amount.

SUMMARY OF THE INVENTION

One object of the present invention is to provide a wet-type image formation apparatus capable of efficiently implementing setting of a toner charging amount.

A wet-type image formation apparatus in accordance with the present invention is a wet-type image formation apparatus forming an image on a recording medium, including: an image carrier carrying an electrostatic latent image; a developer carrier conveying a liquid developer to a development portion serving as a position facing the image carrier, to develop the electrostatic latent image and form a toner image; a charging unit charging toner in the liquid developer conveyed to the development portion; an application unit applying a development bias to the developer carrier; a sensing unit sensing an image density of the toner image; and a control unit controlling the charging unit based on information about a set target range of development characteristics prepared beforehand, wherein a toner charging amount setting operation is performed when a toner charging amount for the toner in the liquid developer conveyed to the development portion is set, and the toner charging amount setting operation includes a sensing operation in which the sensing unit senses image densities of a plurality of patch images formed at different development biases with the toner charging amount being set to a constant value, and a setting operation in which, in a case where the control unit calculates current development characteristics based on the image densities of the plurality of patch images sensed by the sensing unit, and determines that the current development characteristics are not included within the set target range, the control unit controls the charging unit to set the toner charging amount such that the development characteristics are included within the set target range.

Preferably, the set target range includes information about an effective change rate range, and the setting operation has an operation in which, in a case where the control unit calculates a change rate of the image density of the patch image when the image density is increased with respect to an increase in the development bias, as the current development characteristics, and determines that the calculated change rate of the image density is not included within the effective change rate range, the control unit controls the charging unit to set the toner charging amount such that the change rate of the image density is included within the effective change rate range.

Preferably, the plurality of patch images used in the sensing operation include a patch image formed at a development bias when a change in the image density of the patch image is saturated with respect to an increase in the development bias.

Preferably, the wet-type image formation apparatus further includes an adjustment unit adjusting a conveying amount of the toner in the liquid developer conveyed to the development portion, wherein, before the toner charging amount setting operation is performed, the control unit controls the adjustment unit to adjust the conveying amount such that an image density of the patch image formed at the development bias when the change in the image density of the patch image is saturated with respect to the increase in the development bias is within a predetermined target density range.

Preferably, the control unit calculates an anti-fogging potential difference based on the development characteristics set in accordance with setting of the toner charging amount, and controls the application unit based on the anti-fogging potential difference to set the development bias.

Preferably, the control unit first controls the adjustment unit to adjust the conveying amount, and then performs the toner charging amount setting operation and an operation of setting the development bias.

Preferably, the control unit performs an operation of controlling the adjustment unit to adjust the conveying amount and the toner charging amount setting operation, and finally performs an operation of setting the development bias.

Preferably, the control unit further adjusts gradation properties based on an image density of a halftone image formed with the development bias being set.

Preferably, the control unit performs the toner charging amount setting operation when a change in type of the recording medium is sensed and/or when a change in type of the recording medium is input.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
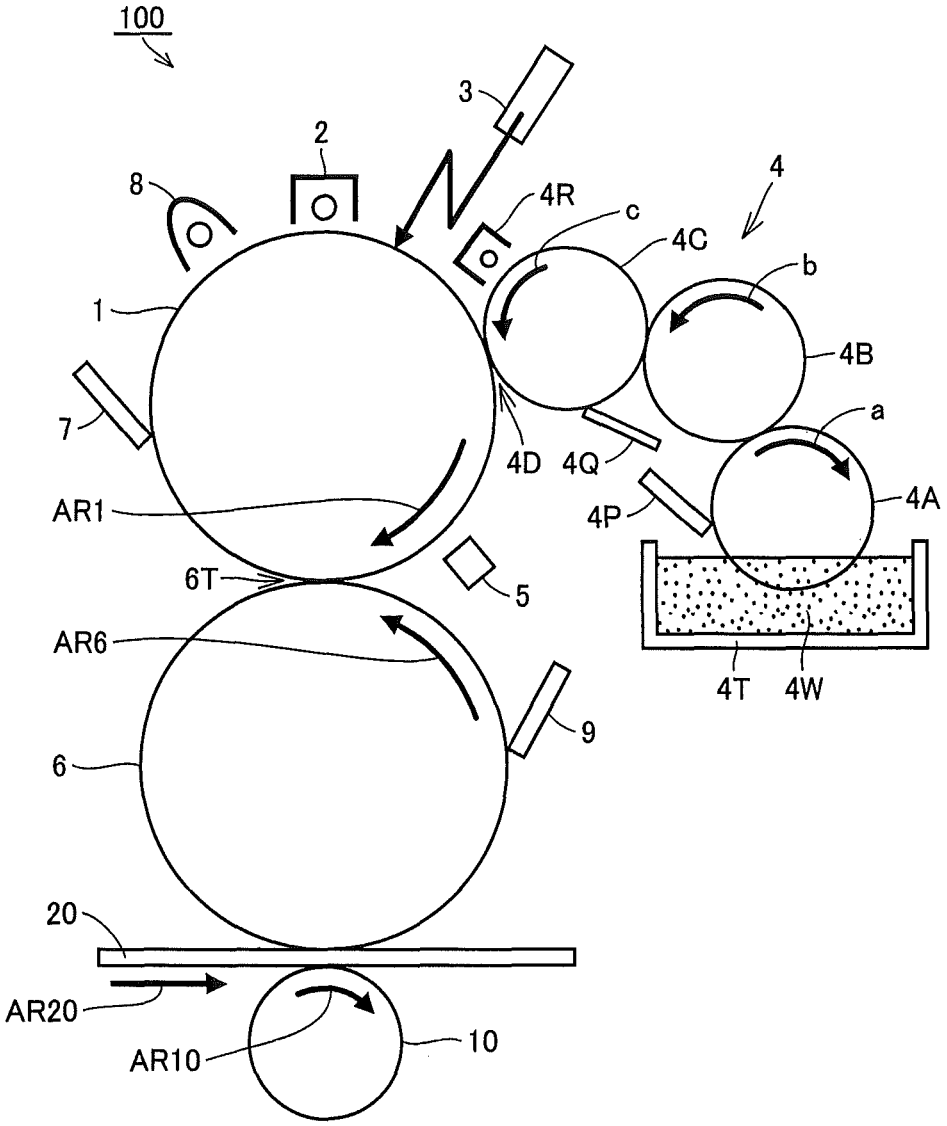
FIG. 1 is a view showing a wet-type image formation apparatus in Embodiment 1.

Hereinafter, embodiments in accordance with the present invention will be described with reference to the drawings. When the number, amount, or the like is referred to in the description of the embodiments, the scope of the present invention is not necessarily limited to such a number, amount, or the like, unless otherwise specified. In the description of the embodiments, identical or corresponding parts will be designated by the same reference numerals, and a redundant description may not be repeated.

Embodiment 1

(Wet-Type Image Formation Apparatus 100)

Figure 2:
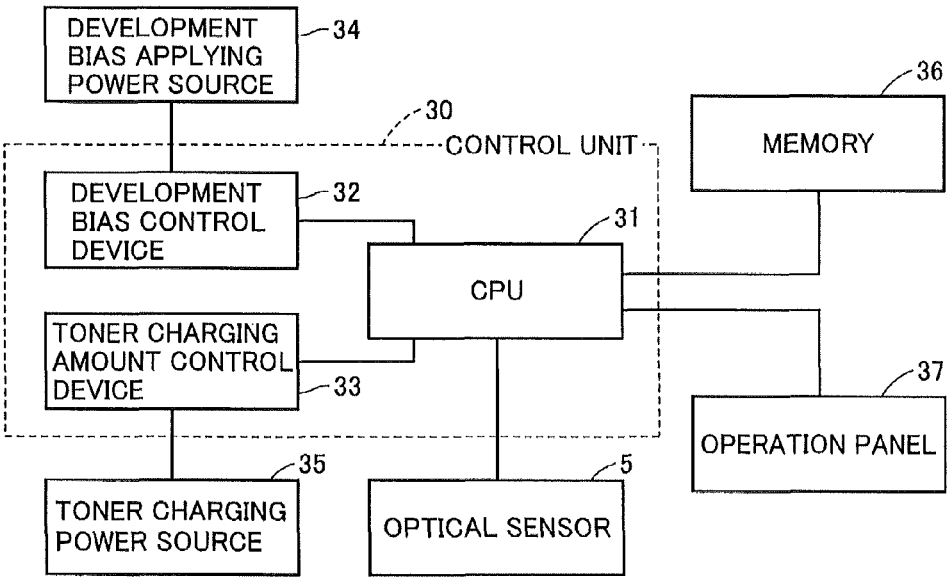
FIG. 2 is a block diagram showing elements of the wet-type image formation apparatus in Embodiment 1.

Referring to FIGS. 1 and 2, a wet-type image formation apparatus 100 in the present embodiment will be described. Wet-type image formation apparatus 100 includes a photoconductor 1 serving as an image carrier, a charging device 2, an exposure device 3, a development device 4, an optical sensor 5 serving as a sensing unit, an intermediate transfer member 6, a cleaning device 7, an eraser lamp 8, a cleaning device 9, a secondary transfer member 10, a control unit 30 serving as a control unit (see FIG. 2), and the like. Control unit 30 includes a CPU (Central Processing Unit) 31 and the like, and controls entire wet-type image formation apparatus 100.

Photoconductor 1 rotates in a direction indicated by an arrow AR1. Photoconductor 1 has a cylindrical shape, and a photoconductor layer (not shown) is formed on a surface thereof. Charging device 2, exposure device 3, development device 4 (a developer carrier 4C), optical sensor 5, intermediate transfer member 6, cleaning device 7, and eraser lamp 8 are arranged in this order around photoconductor 1 along the rotation direction of photoconductor 1. A development portion 4D is formed between photoconductor 1 and developer carrier 4C. A transfer portion 6T is formed between photoconductor 1 and intermediate transfer member 6.

Charging device 2 uniformly charges the surface of photoconductor 1. Exposure device 3 emits light based on image information to the surface of photoconductor 1. The potential at an image portion is reduced, and thereby an electrostatic latent image is formed on the surface of photoconductor 1. The portion of the surface of photoconductor 1 on which the electrostatic latent image is formed moves toward development portion 4D as photoconductor 1 rotates.

(Development Device 4)

Development device 4 includes a developer tank 4T, a liquid developer 4W, a draw-up member 4A, a supply member 4B, developer carrier 4C, a restriction blade 4P, a cleaning member 4Q, a toner charging device 4R serving as a charging unit, and the like. Developer tank 4T stores liquid developer 4W. Liquid developer 4W contains an insulating liquid serving as a carrier liquid, toner (toner particles) formed of a coloring agent, a resin, and the like, and a dispersant for dispersing the toner in the carrier liquid, as main components.

An appropriate volume average particle size of the toner is in the range of more than or equal to 0.1 μm and less than or equal to 5 μm. When the volume average particle size of the toner is more than or equal to 0.1 μm, deterioration in developability can be suppressed. When the volume average particle size of the toner is less than or equal to 5 μm, deterioration in the quality of an image including dots and solid portions can be suppressed. Preferably, the volume average particle size of the toner is more than or equal to 1 μm and less than or equal to 2 μm. When the volume average particle size of the toner is more than or equal to 1 μm, deterioration in cleaning performance can be suppressed. When the volume average particle size of the toner is less than or equal to 2 μm, deterioration in the uniformity of solid portions can also be suppressed.

An appropriate ratio of the toner particles to liquid developer 4W is in the range of more than or equal to 10% by mass and less than or equal to 50% by mass. When the ratio is more than or equal to 10% by mass, the toner particles are less likely to settle out, and temporal stability can be obtained during long-term storage. There is no need to supply the developer in a large amount to obtain a required image density, the carrier liquid adhering to paper can also be reduced, and the carrier liquid can be easily dried during fixing. When the ratio is less than or equal to 50% by mass, the viscosity of the liquid developer does not become too high, which is convenient in terms of manufacturing and handling.

Draw-up member 4A rotates in a direction indicated by an arrow a. A portion of draw-up member 4A is immersed in liquid developer 4W. As draw-up member 4A, a roller made of urethane, a rubber roller made of NBR (Nitrile Butadiene Rubber), an anilox roller provided with recesses in a surface, or the like can be used. As draw-up member 4A rotates, liquid developer 4W is drawn up on a surface of draw-up member 4A. Liquid developer 4W is carried by draw-up member 4A, and thereafter an excessive amount thereof is scraped off by restriction blade 4P to be restricted to a constant film thickness.

Supply member 4B rotates in a direction indicated by an arrow b, and is arranged to abut on draw-up member 4A. As supply member 4B, a roller made of urethane, a rubber roller made of NBR, or the like can be used. The surface of draw-up member 4A and a surface of supply member 4B move in the same direction at a portion where these surfaces abut each other. Liquid developer 4W is delivered from draw-up member 4A to supply member 4B.

Developer carrier 4C rotates in a direction indicated by an arrow c, and is arranged to abut on supply member 4B. As developer carrier 4C, a roller made of urethane, a rubber roller made of NBR, or the like can be used. Although developer carrier 4C has a roller-like shape, a belt-like member may be used. The surface of supply member 4B and a surface of developer carrier 4C move in opposite directions at a portion where these surfaces abut each other.

Liquid developer 4W is delivered from supply member 4B to developer carrier 4C. A thin layer of liquid developer 4W adjusted to have a uniform thickness in a longitudinal direction is formed on developer carrier 4C. Although development device 4 in the present embodiment is composed of three members, that is, draw-up member 4A, supply member 4B, and developer carrier 4C, development device 4 may be composed of two members, that is, draw-up member 4A and developer carrier 4C. In this case, draw-up member 4A also serves as a supply member. The rotation directions of the rollers indicated in the present embodiment may differ from those indicated in FIG. 1.

As developer carrier 4C rotates, the toner in liquid developer 4W which forms the thin layer passes through a portion where developer carrier 4C and toner charging device 4R face each other. As toner charging device 4R, a corotron charger, a scorotron charger, a charging roller, or the like is used. The toner carried by developer carrier 4C is charged by toner charging device 4R. Toner charging device 4R is driven by a toner charging amount control device 33 (FIG. 2) and a toner charging power source 35 (FIG. 2), and is configured to be able to adjust a toner charging amount to a desired value in accordance with an applied voltage.

When a corotron charger is used as toner charging device 4R, the toner charging amount can be adjusted by controlling a voltage applied to a wire. When a scorotron charger is used as toner charging device 4R, the toner charging amount can be adjusted by controlling a grid voltage. When a charging roller is used as toner charging device 4R, the toner charging amount can be adjusted by controlling a voltage applied to a core metal.

In the dry-type electrophotographic method and the like, toner is charged using friction, and thus a toner charging amount is determined in accordance with surface properties between a carrier and the toner, or surface properties between a charging member and a toner material. In the dry-type electrophotographic method and the like, the toner charging amount cannot be arbitrarily adjusted. In contrast, in the wet-type electrophotographic method, an external charging device can be used as a toner charging unit, and a toner charging amount can be adjusted by controlling an output of the device.

(Development Process)

As developer carrier 4C rotates, liquid developer 4W is further conveyed to a portion where developer carrier 4C and photoconductor 1 face each other (development portion 4D). The toner thin layer on developer carrier 4C abuts on photoconductor 1, and develops the electrostatic latent image on photoconductor 1. Specifically, developer carrier 4C is connected to a development bias control device 32 (FIG. 2) and a development bias applying power source 34 (FIG. 2).

Development bias control device 32 (FIG. 2) and development bias applying power source 34 (FIG. 2) serve as an application unit. By the application unit, a development bias (hereinafter also referred to as Vb) is applied to developer carrier 4C. Development bias Vb is configured to be able to be adjusted to a desired value by controlling a voltage applied to developer carrier 4C. An electric field is formed at development portion 4D due to a potential difference between a potential of developer carrier 4C and a potential of the electrostatic latent image carried by photoconductor 1 (development potential difference).

As developer carrier 4C rotates, the toner in the liquid developer conveyed to development portion 4D moves by the action of a force received from the electric field, and adsorbs onto the electrostatic latent image on photoconductor 1. The electrostatic latent image carried on photoconductor 1 becomes visible, and thereby a toner image (or a patch image described later) corresponding to the shape of the electrostatic latent image is formed on the surface of photoconductor 1.

Here, the electrostatic latent image on photoconductor 1 includes a non-image portion potential (hereinafter also referred to as V0) and an image portion potential (hereinafter also referred to as Vi). An non-image portion is a portion of the surface of photoconductor 1 which is uniformly charged by charging device 2. Non-image portion potential V0 is a potential of the non-image portion. An image portion is a portion of the surface of photoconductor 1 which has a reduced potential because a portion of the non-image portion is subjected to exposure by exposure device 3. Image portion potential Vi is a potential of the image portion.

Development bias Vb is set to a value between non-image portion potential V0 and image portion potential Vi. In the non-image portion, an electric field in a direction in which the toner is moved from photoconductor 1 toward developer carrier 4C is formed. In the image portion, an electric field in a direction in which the toner is moved from developer carrier 4C toward photoconductor 1 is formed.

As described above, the electrostatic latent image carried on photoconductor 1 becomes visible, and thereby a toner image (or a patch image described later) corresponding to the shape of the electrostatic latent image is formed on the surface of photoconductor 1. As photoconductor 1 rotates, the toner image passes through a portion where photoconductor 1 and optical sensor 5 face each other. Optical sensor 5 serving as the sensing unit senses an image density of the toner image (patch image) on photoconductor 1, as necessary.

Optical sensor 5 is, for example, a reflective sensor, and a voltage in accordance with the amount of received light is output as an output of the sensor and delivered to CPU 31 (FIG. 2). Data about the output of the sensor is stored in a memory 36 (FIG. 2) as the image density of the patch image. Although the details will be described later, control unit 30 (FIG. 2) controls image formation conditions to optimize the conditions, based on the result of the sensed image density. Thereafter, the toner image is further conveyed toward a portion where photoconductor 1 and intermediate transfer member 6 face each other (transfer portion 6T).

The liquid developer remaining on developer carrier 4C without moving from developer carrier 4C to photoconductor 1 is scraped off from the surface of developer carrier 4C by cleaning member 4Q, and then is collected. Since the collected liquid developer has a toner concentration different from that of liquid developer 4W within developer tank 4T, the liquid developer is transported to a tank (not shown) other than developer tank 4T, in which the toner concentration thereof is adjusted, and thereafter the liquid developer is supplied again into developer tank 4T.

(Primary Transfer Process)

Intermediate transfer member 6 is arranged to face photoconductor 1, and rotates in a direction indicated by an arrow AR6. A transfer bias is applied to intermediate transfer member 6, and an electric field is formed at transfer portion 6T due to a potential difference between a potential of photoconductor 1 and a potential of intermediate transfer member 6. The toner image conveyed to transfer portion 6T as photoconductor 1 rotates is transferred onto a surface of intermediate transfer member 6 by the action of a force received from the electric field.

The toner, the carrier liquid, and the like remaining on photoconductor 1 without moving from photoconductor 1 to intermediate transfer member 6 are scraped off from the surface of photoconductor 1 by cleaning device 7. The charge remaining on the surface of photoconductor 1 is removed by means of exposure by eraser lamp 8, and the surface of photoconductor 1 is made available for next image formation. Eraser lamp 8 is not an essential component, and may be used as necessary.

(Secondary Transfer Process)

Secondary transfer member 10 is arranged to face intermediate transfer member 6, and rotates in a direction indicated by an arrow AR10. A recording medium 20 passes between secondary transfer member 10 and intermediate transfer member 6 in a direction indicated by an arrow AR20 in line with the timing of transfer. A voltage having a polarity opposite to that of the toner particles in the toner image (transfer bias) is applied to secondary transfer member 10. At a nip portion between secondary transfer member 10 and intermediate transfer member 6, the toner image is transferred from intermediate transfer member 6 onto recording medium 20. The toner image is formed on a recording surface of recording medium 20.

(Fixing Process)

Recording medium 20 which carries the toner image is transported to a fixing device not shown. The fixing device fixes the toner image on recording medium 20. The carrier liquid and the toner remaining on intermediate transfer member 6 without being transferred are removed from the surface of intermediate transfer member 6 by cleaning device 9.

By repeating the processes as described above, wet-type image formation apparatus 100 can successively form images on a plurality of recording media. Although wet-type image formation apparatus 100 shown in FIG. 1 includes one set of photoconductor 1 and development device 4, wet-type image formation apparatus 100 may include four sets thereof to form a color image. Images in CMYK colors are formed using four sets of photoconductors 1 and development device 4, and these images are superimposed on intermediate transfer member 6. Other than this configuration, images in CMYK colors may be formed using four sets of photoconductors 1, development device 4, and intermediate transfer members 6, and these images may be superimposed on recording medium 20. Intermediate transfer member 6 is not an essential component, either, and may be used as necessary. In addition, an ordinary electrophotographic process technology can be combined with the configuration of the present embodiment as appropriate depending on the purpose of image formation.

(Relation between Toner Charging Amount and Development Characteristics)

Figure 3:
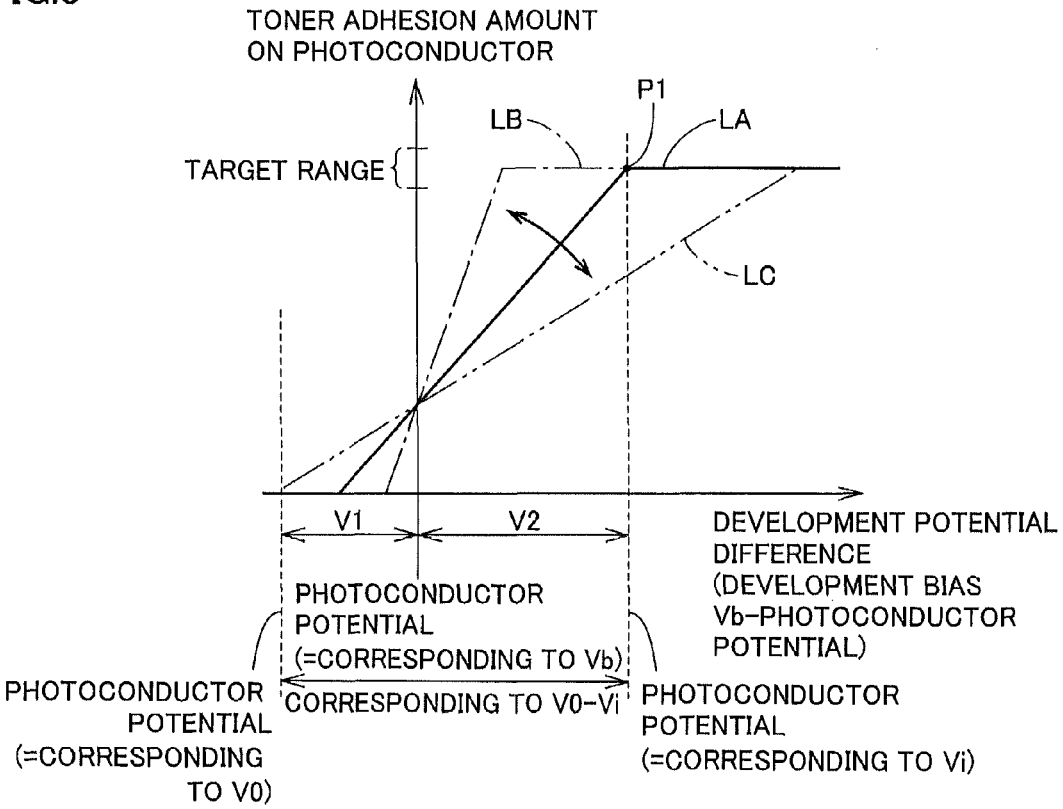
FIG. 3 is a view showing development characteristics when an electrostatic latent image on a photoconductor is developed using a development device, in regard to Embodiment 1.

Prior to providing a description of an image formation condition adjustment operation ST1000 (FIG. 6), the relation between the toner charging amount and development characteristics will now be described with reference to FIG. 3. FIG. 3 is a view showing development characteristics when an electrostatic latent image on the photoconductor is developed using the development device. The axis of abscissas in FIG. 3 represents a development potential difference provided between the photoconductor and the developer carrier, that is, (development bias Vb—a surface potential of the photoconductor). When the surface potential of the photoconductor is identical, the development potential difference is increased with an increase in development bias Vb. The axis of ordinate in FIG. 3 represents the amount of toner adhering to the surface of the photoconductor by development.

An intersection of the axis of abscissas and the axis of ordinate in FIG. 3 represents a case where the surface potential of the photoconductor is equal to development bias Vb. For the sake of convenience, it is assumed in the present description that the toner has a positive charging polarity. It is assumed in the present embodiment that the amount of the liquid developer on the developer carrier and the toner concentration thereof are adjusted beforehand such that the image density of a toner image is within a target range when substantially 100% of the toner on the developer carrier moves to the photoconductor.

Referring to a line LA in FIG. 3, line LA indicates development characteristics in a case where a voltage applied to the toner charging device is controlled to a certain value. As the development potential difference is increased, that is, as the development potential difference is moved to the right in FIG. 3, more toner moves from the developer carrier to the photoconductor. More specifically, a development potential difference V1 in FIG. 3 indicates a value which corresponds to non-image portion potential V0 on the photoconductor. When the development potential difference is set to a small value close to development potential difference V1, a reverse bias state is formed. An electric field formed at the development portion in the reverse bias state acts in a direction in which the toner is moved from the photoconductor to the developer carrier (i.e., in an opposite direction), and thus the toner is not made available for development.

As the development potential difference is gradually increased (i.e., as the reverse bias is weakened), the electric field acts in the opposite direction, but the toner starts adhering to the photoconductor little by little, due to an electric field formed by the toner itself. When the development potential difference is further increased, the electric field acts in a direction in which the toner is moved from the developer carrier to the photoconductor. The amount of the toner adhering on the photoconductor is increased, and development is facilitated. After the development potential difference is set to a value at which all of the toner is moved to the photoconductor, the amount of the toner which is made available for development is no longer increased (see a point P1 in the drawing). The toner adhesion amount on the photoconductor is not increased, either.

In a range from the development potential difference corresponding to point P1 (also referred to as a saturated development potential difference) or more, the toner adhesion amount on the photoconductor is almost saturated. Even if image formation conditions such as the development bias, a charging bias, exposure energy, and the like are somewhat changed, the image density of a toner image (patch image) formed in the range from the saturated development potential difference or more is rarely changed. In the wet-type electrophotographic method, generally, the development potential difference is set to the saturated development potential difference or more.

A dashed-dotted line LB and a dashed-two dotted line LC each indicate development characteristics in a case where the voltage applied to the toner charging device is changed to change the toner charging amount with respect to the case of line LA. Specifically, dashed-dotted line LB indicates development characteristics in a case where the toner charging amount is decreased when compared with the case of line LA. Dashed-two dotted line LC indicates development characteristics in a case where the toner charging amount is increased when compared with the case of line LA. By changing the toner charging amount as indicated by lines LA, LB, LC, a gradient of an inclined portion of the development characteristics is changed. This phenomenon can be explained as described below.

In the development process in the wet-type electrophotographic method, the development potential difference is formed between the surface potential of the photoconductor and the development bias. As the toner adheres on the photoconductor, the charge of the toner is applied to the surface of the photoconductor. The charge of the toner increases the surface potential of the photoconductor, and thereby the development potential difference is decreased (i.e., canceled). When the surface potential of the photoconductor reaches the development potential difference, movement of the toner to the photoconductor is finished.

When the toner charging amount is increased, the charging amount for each toner particle is increased, and thus the development potential difference is canceled with a small amount of toner. Therefore, in this case, the amount of the toner moving from the developer carrier to the photoconductor is decreased. Since the amount of the toner moving onto the photoconductor is decreased, the toner adhesion amount with respect to the development potential difference is decreased, and the inclined portion of line LC has a smaller gradient than that of line LA in FIG. 3.

On the other hand, when the toner charging amount is decreased, the charging amount for each toner particle is decreased, and thus the development potential difference is canceled with a larger amount of toner. Therefore, in this case, the amount of the toner moving from the developer carrier to the photoconductor is increased. Since the amount of the toner moving onto the photoconductor is increased, the toner adhesion amount with respect to the development potential difference is increased, and the inclined portion of line LB has a larger gradient than that of line LA in FIG. 3.

(Relation between Toner Charging Amount and Image Quality)

As described in the beginning, occurrence of image noise can be suppressed by setting the charging amount of the toner in the liquid developer conveyed to the development portion to a value that is as high as possible. Examples of the image noise include rivulets, rear edge shift, and deterioration of dot reproduction. All of these are phenomena caused by the toner charging amount being set to a low value. These phenomena will be described below in order.

Rivulets are a phenomenon that the liquid developer is pulled by both the photoconductor and the developer carrier in the vicinity of an exit of a nip portion of the development portion, and thereby the liquid developer cannot be uniformly separated and moves in a plane direction, and the moved liquid developer appears in an irregular streak-like pattern.

Rear edge shift is a phenomenon that the liquid developer which does not enter the nip portion of the development portion in the vicinity of an entrance of the nip portion moves downstream in the rotation direction of the developer carrier, and thereby the toner is shifted toward an rear edge of an image, and a toner image is formed to be shifted toward the rear edge of the image with respect to an electrostatic latent image.

Deterioration of dot reproduction is a phenomenon that sharpness of a halftone image is deteriorated, and is a phenomenon that a toner image does not faithfully reproduce the shape of an electrostatic latent image in the presence of various factors for image noise. Deterioration of dot reproduction tends to be worsened with an increase in factors which impair faithful reproduction of an electrostatic latent image.

Around the nip portion of the development portion, flow of the carrier liquid occurs due to various factors. When the toner charging amount is high, the toner moves in the carrier liquid in a shorter amount of time, and the toner is less influenced by the flow of the carrier liquid. The effect of electrostatically attracting the toner acting toward the electrostatic latent image is enhanced, and the toner can faithfully adhere to the electrostatic latent image without being influenced by the flow of the carrier liquid. As a result, various factors causing image disturbance are suppressed, and image formation having high image quality can be implemented.

(Relation between Toner Charging Conditions and Conditions for Potential of Photoconductor)

Although it is preferable to set the charging amount of the toner to a value that is as high as possible, if the toner charging amount is set to be higher than necessary, the inclined portion of the development characteristics has a too small gradient. In this case, the amount of toner used for development in a limited development potential difference is decreased, and development efficiency is reduced. This will be described below more specifically.

Referring to FIG. 3 again, when image formation is not performed, the development potential difference can be freely set by fixing the surface potential of the photoconductor and changing the development bias. On the other hand, when image formation is performed, both an image portion and a non-image portion exist. The development bias has a constant value with respect to the image portion and the non-image portion. To allow implementation of appropriate development in both the image portion and the non-image portion, it is necessary to set both a development potential difference for the image portion and a development potential difference for the non-image portion to appropriate values.

Development potential difference V1 shown in FIG. 3 indicates a development potential difference in the non-image portion (when the surface potential of the photoconductor is at non-image portion potential V0) when the surface potential of the photoconductor is charged under certain charging conditions and the image portion is subjected to exposure under certain exposure conditions. A development potential difference V2 indicates a development potential difference in the image portion (when the surface potential of the photoconductor is at image portion potential Vi) when the surface potential of the photoconductor is charged under certain charging conditions and the image portion is subjected to exposure under certain exposure conditions.

In the case where the toner charging amount is set high and the development characteristics indicated by dashed-two dotted line LC are obtained, the toner adhesion amount is less than a target range in development potential difference V2, and thus this case is undesirable. On the other hand, in the case where the toner charging amount is set low and the development characteristics indicated by dashed-dotted line LB are obtained, the toner adhesion amount is within the target range in development potential difference V2. However, this case is also undesirable, because there is room for further increase in the toner charging amount and decrease in the gradient of the inclined portion of the development characteristics. Ideally, it is preferable to implement development characteristics as indicated by line LA with respect to the surface potential of the photoconductor, that is, to set the toner adhesion amount to be within the target range and set the toner charging amount to a value that is as high as possible while maintaining the toner adhesion amount within that range.

(Influence of Surface Potential of Photoconductor on Setting of Toner Charging Amount)

When the toner charging amount is increased, it is necessary to also consider development potential difference V2. Although the above description has been given based on a case where development potential difference V2 is set to a certain value, if it is assumed that the value of development potential difference V2 is further increased, and further shifted to the right in FIG. 3, the gradient of the inclined portion of the development characteristics can be further decreased. In other words, if the value of development potential difference V2 can be increased, the toner charging amount can be increased accordingly. Actually, however, the value that development potential difference V2 can have is restricted by the surface potential that the photoconductor can have.

The photoconductor includes a conductive base body made of aluminum or the like, and a photosensitive layer provided on a surface of the base body. The photosensitive layer is a portion having a constant thin film thickness, and has insulation properties when it is not subjected to exposure. When a significantly high charge is applied to the photosensitive layer, the photosensitive layer cannot stand the voltage, and breakdown occurs. The surface potential of the photosensitive layer has a limited value, which is generally several hundred volts, although depending on the type of the photosensitive layer. Therefore, since the surface potential of the photoconductor (non-image portion potential V0) has a limited value for practical use, and image portion potential Vi after exposure is close to 0 V, the value of (non-image portion potential V0—image portion potential Vi) also has a maximum value determined by the type of the photoconductor.

Figure 4:
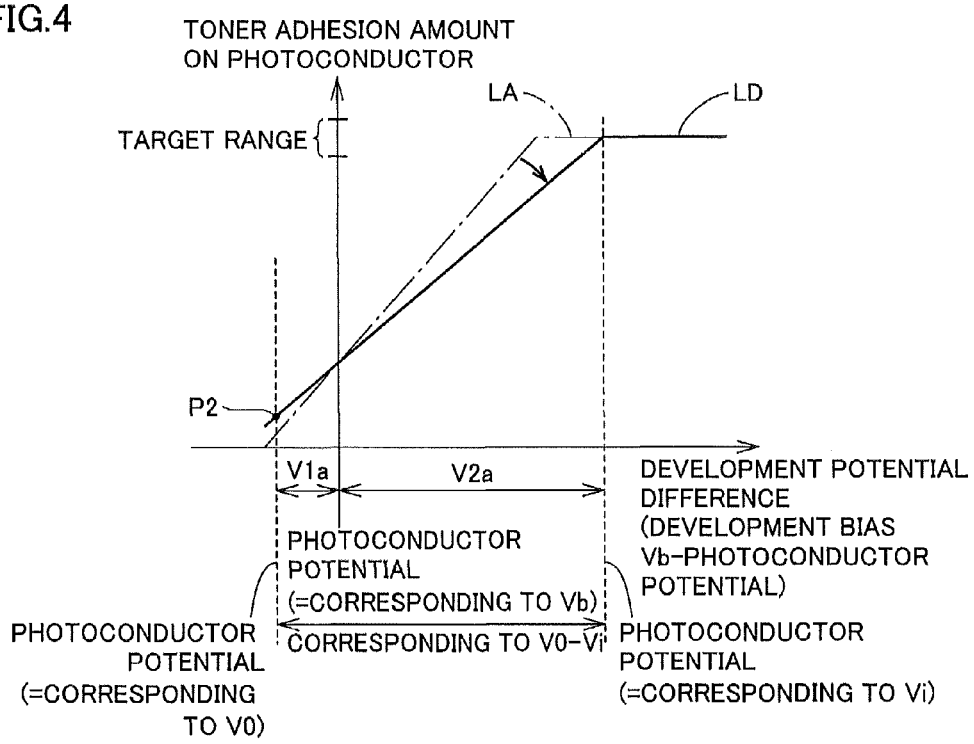
FIG. 4 is a view for explaining a state in which a development bias is moved away from an image portion potential and set to a value close to a non-image portion potential, in regard to Embodiment 1.

Referring to FIG. 4, it is assumed that development bias Vb is moved away from image portion potential Vi and set to a value close to non-image portion potential V0, in order to increase the development potential difference in the image portion. In this case, the development potential difference in the image portion is increased to a development potential difference V2*a*. The development characteristics can be changed from those indicated by line LA to those indicated by a line LD, and the gradient that the inclined portion of the development characteristics can have can be decreased. In this case, however, the development potential difference in the non-image portion is decreased to a development potential difference V1*a*, and as a result the toner adhesion amount in the non-image portion (development potential difference V1) is not zero, and thus a so-called fogging phenomenon occurs in the non-image portion (see a point P2 in the drawing). That is, development characteristics as indicated by line LD cannot be adopted as image formation conditions.

(Relation between Adjustment of Development Bias Vb and Toner Charging Amount)

To prevent occurrence of a fogging phenomenon in the non-image portion, it is contemplated to set development bias Vb to a value which is away from image portion potential Vi enough to avoid occurrence of a fogging phenomenon even if the toner charging amount is changed in the range for practical use. In this case, however, it is contemplated that development potential difference V1 is increased more than necessary. The difference between development potential difference V1 and development potential difference V2 is equal to non-image portion potential V0—image portion potential Vi. Increasing development potential difference V1 means decreasing development potential difference V2. Thus, when development bias Vb is set based on such an idea, it is not possible to sufficiently decrease the gradient of the inclined portion of the development characteristics, and it is difficult to set the toner charging amount to a value that is as high as possible.

(Image Formation Condition Adjustment Operation ST1000)

Figure 5:
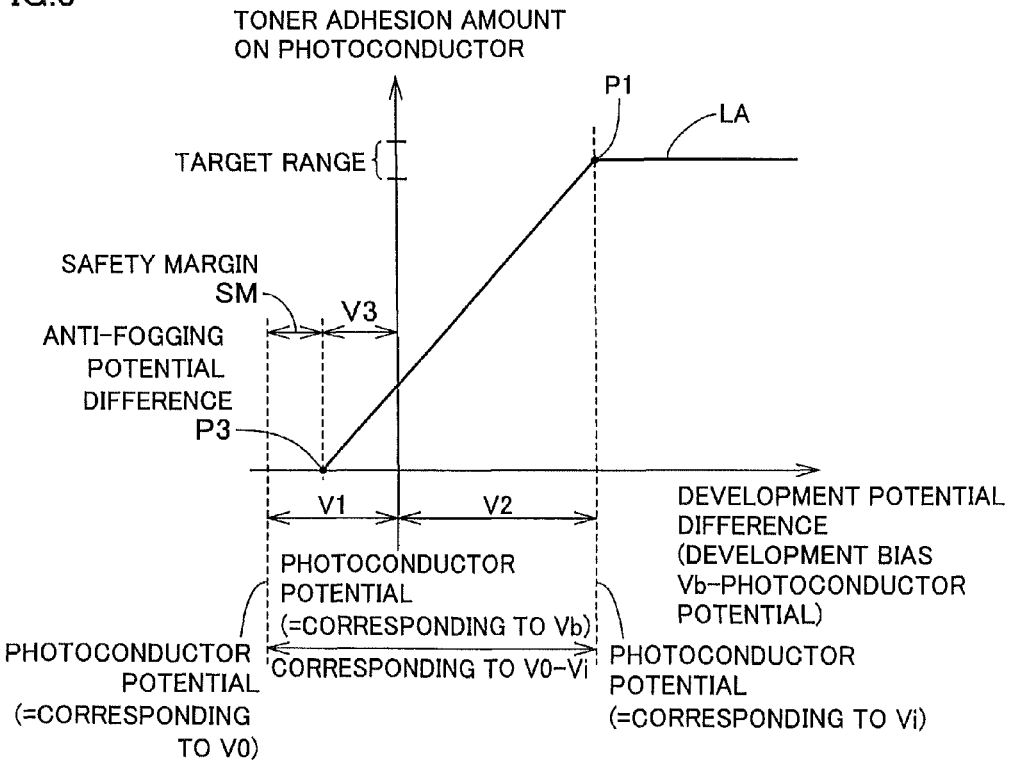
FIG. 5 is a view showing development characteristics obtained by the wet-type image formation apparatus in Embodiment 1 performing an image formation condition adjustment operation.

Referring to FIG. 5, image formation condition adjustment operation ST1000 (FIG. 6) is performed in wet-type image formation apparatus 100 (FIG. 1) of the present embodiment. The toner charging amount and the development bias are each set such that development characteristics as indicated by line LA in FIG. 5 can be obtained. That is, development potential difference V1 is set to a value in accordance with a limit development potential difference causing no fogging phenomenon which is derived from the gradient of the inclined portion of the development characteristics (hereinafter also referred to as an anti-fogging potential difference V3).

Development potential difference V1 may be set to the same value as that of anti-fogging potential difference V3 (a value indicated by a point P3 in FIG. 5), or a constant safety margin SM may be ensured as shown in FIG. 5 and development potential difference V1 may be set to a value of (anti-fogging potential difference V3+safety margin SM). The value of anti-fogging potential difference V3 (at the position of point P3) is changed in accordance with a change in the gradient of the inclined portion of the development characteristics. Therefore, in the present embodiment, development bias Vb is set such that development potential difference V1 is set to a value that is as small as possible and development potential difference V2 is increased as much as possible, in accordance with the gradient of the inclined portion of the development characteristics.

By setting image formation conditions to have such development characteristics by image formation condition adjustment operation ST1000, the toner charging amount can be set to a value that is as high as possible, without causing a fogging phenomenon and with a required image density in the image portion being ensured. Hereinafter, image formation condition adjustment operation ST1000 in the present embodiment will be specifically described.

Figure 6:
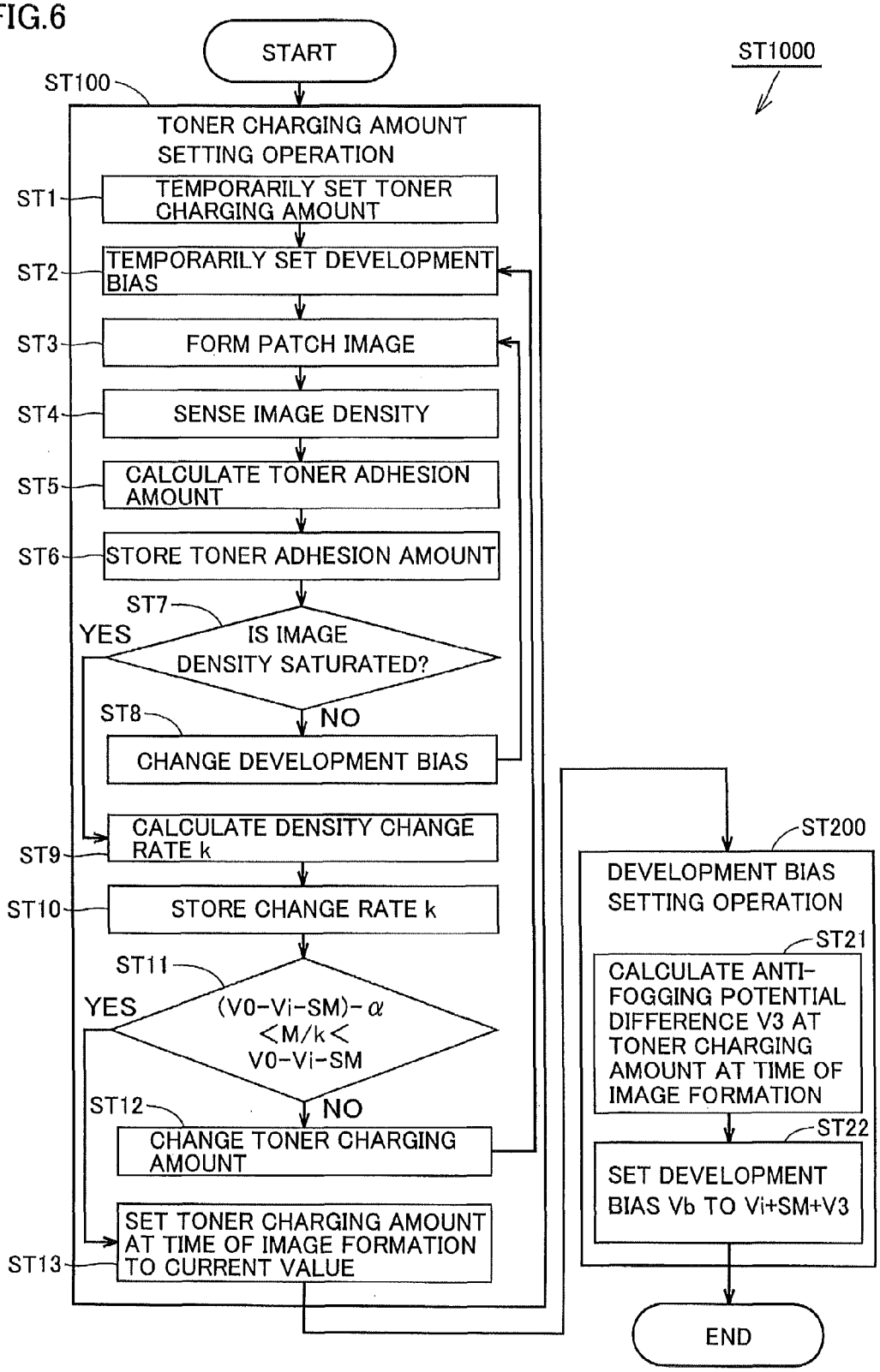
FIG. 6 is a flowchart illustrating the image formation condition adjustment operation performed by the wet-type image formation apparatus in Embodiment 1.

FIG. 6 is a flowchart illustrating image formation condition adjustment operation ST1000 performed in wet-type image formation apparatus 100 (FIG. 1) of the present embodiment. Image formation condition adjustment operation ST1000 includes a toner charging amount setting operation ST100 and a development bias setting operation ST200. First, toner charging amount setting operation ST100 is performed. Toner charging amount setting operation ST100 is performed for example when a sensor (not shown) senses a change in the type of the recording medium, and/or when a change in the type of the recording medium is input to an operation panel 37 (FIG. 2) or the like. As described above, to obtain the development characteristics as indicated by line LA in FIG. 5, development potential difference V1 is set in accordance with the value of anti-fogging potential difference V3. Anti-fogging potential difference V3 is changed in accordance with the gradient of the inclined portion of the development characteristics.

Therefore, data about the gradient of the inclined portion of the development characteristics (a density change rate k of the image density of the patch image when the image density is increased with respect to an increase in the development bias) is obtained, and an optimal value of the toner charging amount controlled by the toner charging device is calculated from the data. Anti-fogging potential difference V3 (value indicated by point P3 in FIG. 5) is perceived from the toner charging amount set based on the data, and thereafter development bias Vb is determined. With this order, image formation conditions can be set efficiently.

(Toner Charging Amount Setting Operation ST100)

Specifically, first, the toner charging amount is set to a temporary value (ST1). Although any value can be adopted as the temporary value of the toner charging amount, it is preferable to adopt a value having a sufficiently low toner charging amount, or a value having a sufficiently high toner charging amount. As the temporary value of the toner charging amount, a value adopted when previous image formation condition adjustment operation ST1000 was performed may be adopted.

Next, development bias Vb is also set to a temporary value (ST2). Although any value can be adopted as the temporary value of development bias Vb, it is preferable to adopt a sufficiently low value which is experimentally perceived beforehand. The temporary value of development bias Vb is preferably set to a value considering a difference between development bias Vb and image portion potential Vi, such that a plurality of patch images can be formed (in the next step) with the development potential difference being set to a sufficiently low value.

Next, a patch image is formed (ST3). Specifically, a patch image is formed by driving the development device and the photoconductor, setting a potential of an electrostatic latent image for forming the patch image (a surface potential of the photoconductor) to image portion potential Vi, and applying development bias Vb set in step ST2 to the developer carrier. Next, an image density of the patch image is sensed using optical sensor 5 (ST4).

CPU 31 of control unit 30 (FIG. 2) reads a conversion table or a conversion expression prepared based on an experiment and the like performed beforehand, from memory 36, and calculates an adhesion amount of the toner adhering to the photoconductor from the image density sensed by optical sensor 5 (ST5). Data about the adhesion amount of the toner is stored in memory 36 (ST6). When the result of the calculated adhesion amount of the toner is shown for example on a graph, the result is plotted as a point PL1 in FIG. 7.

Next, whether or not the image density is saturated is determined (ST7). In this step, determination as NO is made, because there are not enough elements for determining whether or not the image density is saturated, in the first stage in which development bias Vb is set to the temporary value, with the toner charging amount being set to a current value. Thereafter, development bias Vb is changed from the value in the first stage to be increased by a predetermined value (ST8).

Figure 7:
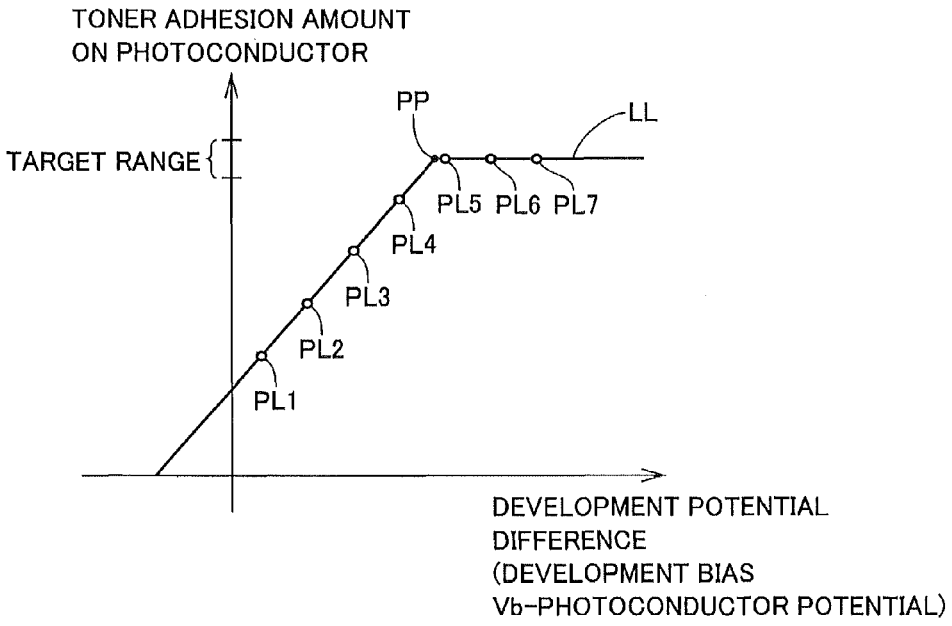
FIG. 7 is a view for explaining a toner charging amount setting operation of the image formation condition adjustment operation performed by the wet-type image formation apparatus in Embodiment 1.

A patch image is formed again (ST3), and an image density thereof is sensed (ST4). An adhesion amount of the toner is calculated (ST5), and data about the adhesion amount of the toner is stored (ST6). When the result of the calculated adhesion amount of the toner is shown for example on the graph, the result is plotted as a point PL2 in FIG. 7. Steps ST3 to ST8 are repeated by the number of times enough to determine whether or not the image density is saturated, and data such as points PL3, PL4 in FIG. 7 are sequentially obtained. Therefore, toner charging amount setting operation ST100 of the present embodiment includes a sensing operation in which optical sensor 5 senses image densities of a plurality of patch images formed at different development biases Vb with the toner charging amount being set to a constant value.

As development bias Vb is increased, the data about the adhesion amount of the toner reaches a saturated region at a certain location (at a time point beyond a point PP in FIG. 7), as shown in a point PL5 in FIG. 7. In the saturated region, substantially all of the toner on the developer carrier moves to the photoconductor. As indicated by points PL5 to PL7 in FIG. 7, the amount of the toner which is made available for development is no longer increased even if development bias Vb is increased, and the toner adhesion amount on the photoconductor is not increased, either.

When such a state is established, it is determined that the image density is saturated (YES in step ST7). The determination for saturation can be made based on a threshold, for example, based on whether or not data of the development potential difference adjacent to obtained data is less than or equal to ±δ% (where δ is an allowable value set taking errors and variations into account) with respect to the obtained data.

Next, density change rate k is calculated (ST9). Density change rate k corresponds to the gradient of the inclined portion of the development characteristics excluding the saturated region, and can be calculated based on points PL1 to PL4 in FIG. 7. Data about calculated density change rate k is stored in memory 36 (ST10). Although four points PL1 to PL4 in FIG. 7 are obtained to calculate density change rate k in the present embodiment, two points may be obtained, or the number of points can be set to any number more than 2.

Points PL5 to PL7 are data included within the saturated region, and are not directly referred to in calculating density change rate k. However, density change rate k can be calculated with high accuracy, because the plurality of patch images used in the sensing operation include a patch image formed at a development bias when a change in the image density of the patch image is saturated with respect to an increase in the development bias.

Next, it is determined whether or not density change rate k satisfies conditions under which the toner adhesion amount is set to be within the target range and the toner charging amount can be set to a value that is as high as possible while maintaining the toner adhesion amount within that target range (ST11). In other words, it is determined whether or not density change rate k is included within an effective change rate range which is prepared beforehand and stored within memory 36. When it is determined that density change rate k does not satisfy the conditions, control unit 30 controls toner charging device 4R to change the toner charging amount such that density change rate k is included within the effective change rate range.

Other than the operation of calculating density change rate k (ST9), control unit 30 may calculate current development characteristics LL (FIG. 7) itself based on the image densities (points PL1 to PL7) of the plurality of patch images sensed by optical sensor 5. In this case, data about development characteristics LL (FIG. 7) at a currently set toner charging application amount is stored in memory 36. Control unit 30 determines whether or not development characteristics LL at the currently set toner charging application amount are included within a set target range. Information about the set target range of the development characteristics is prepared beforehand and stored within memory 36. When control unit 30 determines that development characteristics LL are not included within the set target range, control unit 30 controls toner charging device 4R to change the toner charging amount such that development characteristics LL are included within the set target range.

In the present embodiment, density change rate k is calculated as current development characteristics, and it is determined whether or not density change rate k is included within the effective change rate range. This determination will be specifically described below with reference to FIGS. 8 to 10.

Figure 8:
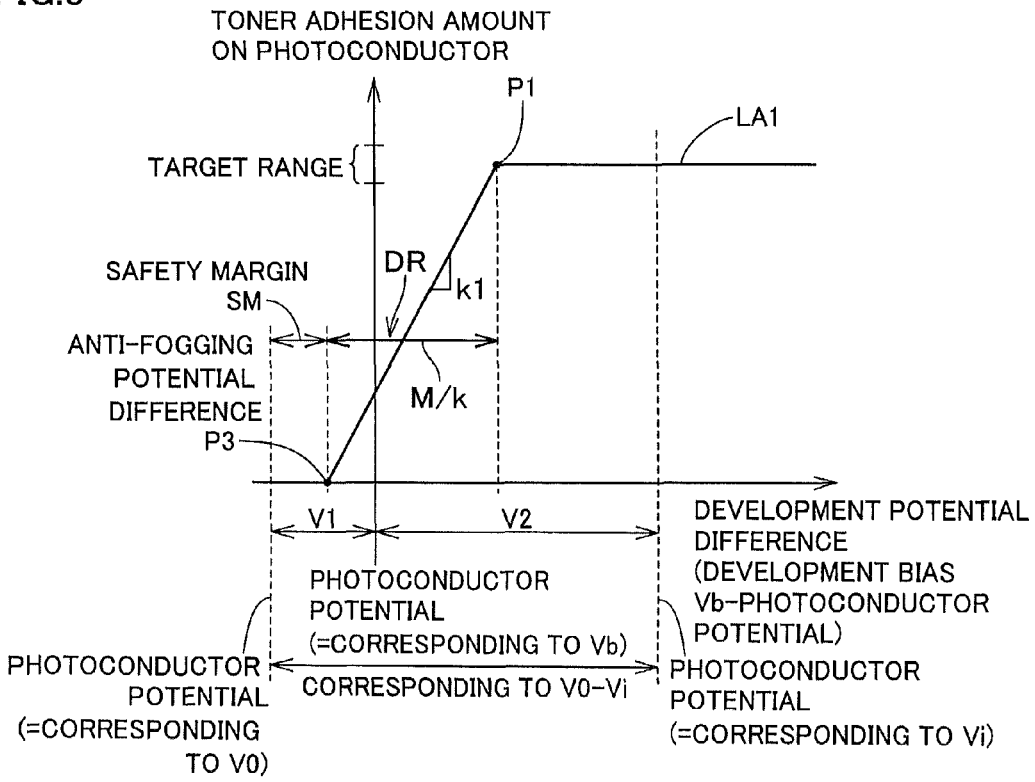
FIG. 8 is a view showing development characteristics in a case where a toner charging amount is lower than necessary, in regard to the toner charging amount setting operation in Embodiment 1.
Figure 9:
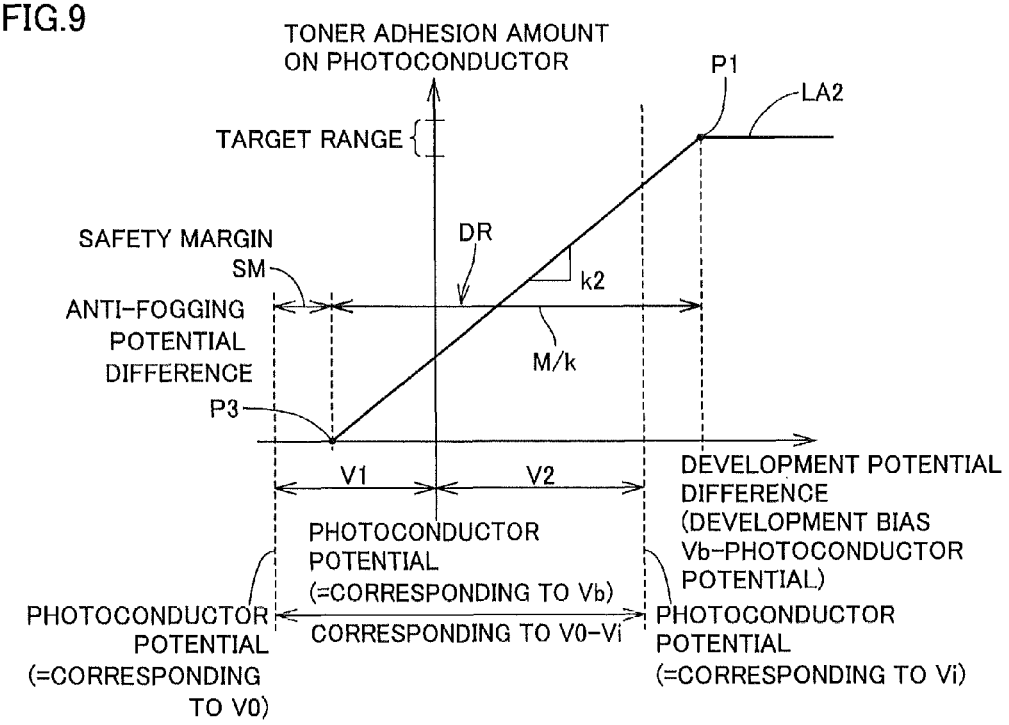
FIG. 9 is a view showing development characteristics in a case where a toner charging amount is higher than necessary, in regard to the toner charging amount setting operation in Embodiment 1.
Figure 10:
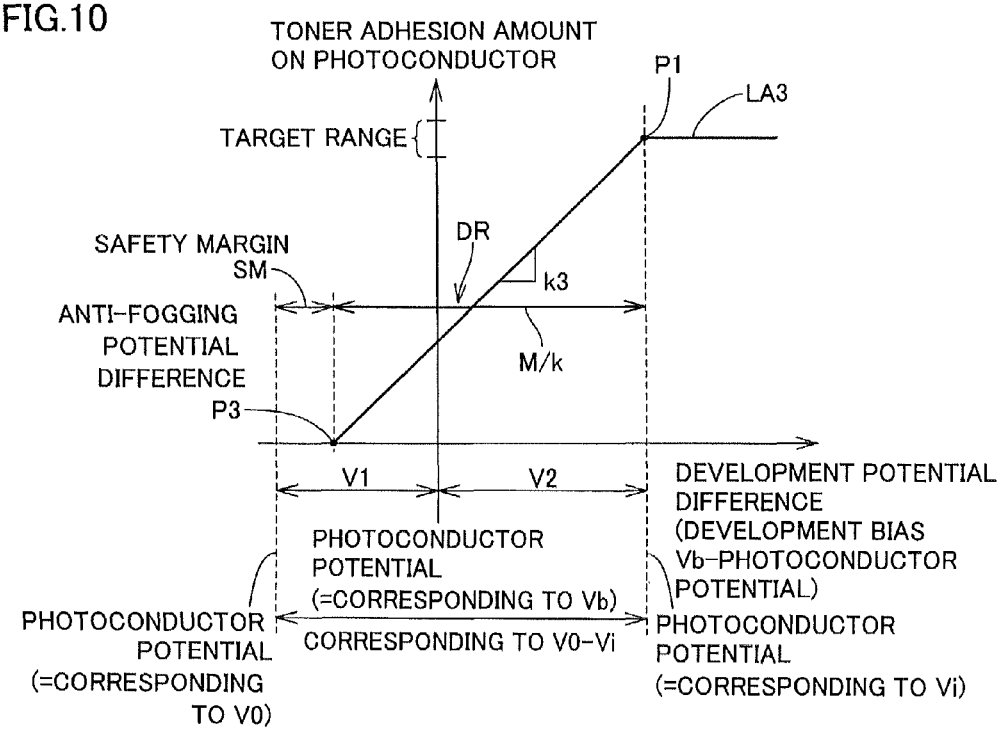
FIG. 10 is a view showing development characteristics in a case where a toner charging amount is appropriate, in regard to the toner charging amount setting operation in Embodiment 1.
Figure 11:
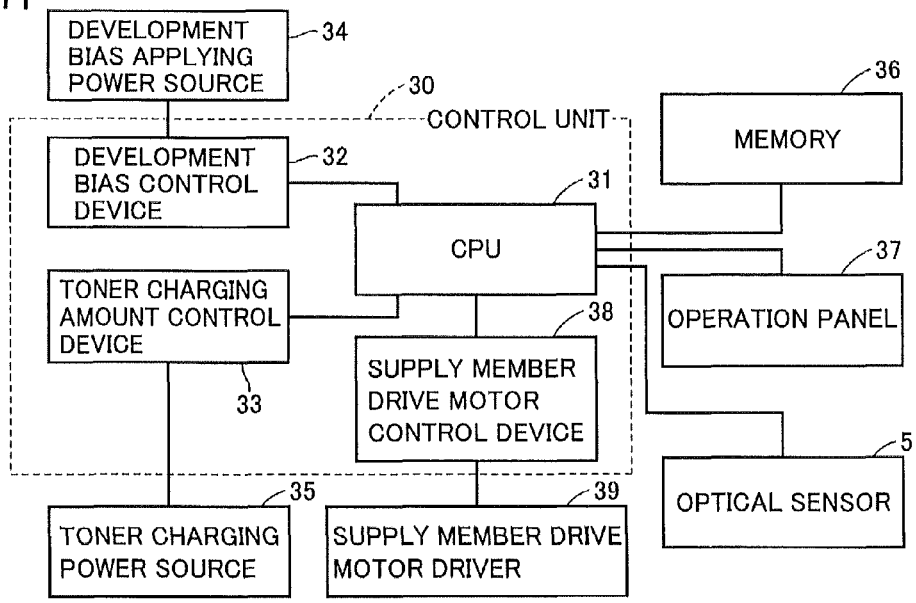
FIG. 11 is a block diagram showing elements of a wet-type image formation apparatus in Embodiment 2.

FIGS. 8 to 10 are views showing development potential difference V1 in the non-image portion and development potential difference V2 in the image portion presumed from settings of a target toner adhesion amount M, safety margin SM, and toner charging amounts thereof, in the cases of different density change rates k1 to k3 (development characteristics LA1, LA2, LA3). Target toner adhesion amount M and safety margin SM are prepared beforehand and stored within memory 36 as information about the effective change rate range of density change rate k (or information about the set target range of the development characteristics).

Referring to FIG. 8, it is assumed that current development characteristics are set as indicated by development characteristics LA1 in the drawing. When it is determined that the image density is saturated (when it is determined as YES in step ST7), it is already perceived that the current development characteristics are set as indicated by LA1. A potential difference indicated by an arrow DR in the drawing is a potential difference of an inclined portion of development characteristics LA1. This potential difference is derived from M/k, where M is the target adhesion amount of the toner (target image density), and k (here, k1) is the density change rate.

To set the toner charging amount to a value that is as high as possible without causing a fogging phenomenon and with a required image density in the image portion being ensured, a value obtained by adding safety margin SM to potential difference M/k of the inclined portion is set to be equal to (development potential difference V2—development potential difference V1), that is, (non-image portion potential V0—image portion potential Vi). Therefore, it is ideal that the condition M/k=V0−Vi−SM is satisfied.

In the actual settings, a certain range is provided in determining the settings. For example, it is determined whether or not the relation (V0−Vi−SM)−α<(M/k)<(V0−Vi−SM) is satisfied. The reason for allowing the range that can be set for M/k to be decreased by −α is to set M/k such that the development characteristics are surely saturated in the image portion. In the present embodiment, the range larger than (V0−Vi−SM)−α and smaller than (V0−Vi−SM) corresponds to the effective change rate range. In the present embodiment, the information about the effective change rate range is prepared beforehand based on target toner adhesion amount M, safety margin SM, characteristics of the photoconductor, and the like, and stored within memory 36.

The inclined portion of development characteristics LA1 shown in FIG. 8 has density change rate k (here, k1). M/k<V0−Vi−SM is satisfied, and density change rate k (k1) is not included within the effective change rate range. Development characteristics LA1 have room for further increase in the toner charging amount and decrease in the gradient of the inclined portion of the development characteristics. In such a case, it is determined as NO in step ST11, toner charging device 4R is controlled, and the toner charging amount is increased by a constant amount (ST12). Thereafter, steps ST2 to ST10 are repeated. This flow is repeated until density change rate k is included within the effective change rate range (until it is determined as YES in step ST11).

Referring to FIG. 9, it is assumed that current development characteristics are set as indicated by development characteristics LA2 in the drawing. When it is determined that the image density is saturated (when it is determined as YES in step ST7), it is already perceived that the current development characteristics are set as indicated by LA2. A potential difference indicated by arrow DR in the drawing is a potential difference of an inclined portion of development characteristics LA2. This potential difference is derived from M/k, where M is the target adhesion amount of the toner (target image density), and k (here, k2) is the density change rate.

The inclined portion of development characteristics LA2 shown in FIG. 9 has density change rate k (here, k2). M/k>V0−Vi−SM is satisfied, and density change rate k (k2) is not included within the effective change rate range. Development characteristics LA2 are formed at a toner charging amount that is higher than necessary. If the toner charging amount is not decreased, there is a possibility that a target density range cannot be reached in the image portion (development potential difference V2), and a fogging phenomenon occurs in the non-image portion. In such a case, it is determined as NO in step ST11, toner charging device 4R is controlled, and the toner charging amount is decreased by a constant amount (ST12). Thereafter, steps ST2 to ST10 are repeated. This flow is repeated until density change rate k is included within the effective change rate range (until it is determined as YES in step ST11).

Referring to FIG. 10, it is assumed that current development characteristics are set as indicated by development characteristics LA3 in the drawing. When it is determined that the image density is saturated (when it is determined as YES in step ST7), it is already perceived that the current development characteristics are set as indicated by LA3. A potential difference indicated by arrow DR in the drawing is a potential difference of an inclined portion of development characteristics LA3. This potential difference is derived from M/k, where M is the target adhesion amount of the toner (target image density), and k (here, k3) is the density change rate.

In the case of development characteristics LA3 shown in FIG. 10, the relation M/k≈V0−Vi−SM is satisfied. Density change rate k (k3) is included within the effective change rate range. Development characteristics LA3 can implement setting of the toner charging amount to a value that is as high as possible without causing a fogging phenomenon and with a required image density in the image portion being ensured. In such a case, it is determined as YES in step ST11. In step ST13, a toner charging amount at the time of forming an ordinary image is set to the current value (the value of the toner charging amount forming development characteristics LA3). Thus, conditions under which the toner charging amount can be set to a value that is as high as possible can be efficiently set by calculating current density change rate k while changing development bias Vb, and optimizing the toner charging amount through computation.

(Development Bias Setting Operation ST200)

Next, development bias setting operation ST200 is performed. First, anti-fogging potential difference V3 at the toner charging amount set in toner charging amount setting operation ST100 is acquired from the charging conditions at the time of image formation (development characteristics LA3) stored in memory 36 (ST21).

Next, development bias Vb is set (ST22).

Specifically, a value obtained by adding anti-fogging potential difference V3 to safety margin SM is equal to an appropriate fogging margin (Vb−Vi) which implements setting of the toner charging amount to a value that is as high as possible with a required image density in the image portion being ensured. Therefore, development bias Vb can be determined from (development bias Vb=image portion potential Vi+safety margin SM+anti-fogging potential difference V3). This value is set as a development bias at the time of forming an ordinary image, and image formation condition adjustment operation ST1000 is finished.

(Function and Effect)

In the present embodiment, the image densities of the plurality of patch images formed at different development biases Vb with the toner charging amount being set to a constant value are sensed. That is, conditions under which the toner charging amount can be set to a value that is as high as possible can be efficiently set by calculating current density change rate k while changing development bias Vb, and optimizing the toner charging amount through computation.

In the present embodiment, density change rate k of the image density of the patch image when the image density is increased with respect to an increase in the development bias is calculated, and the toner charging amount is controlled based on density change rate k. Efficient computation can be implemented by using density change rate k as an element for determining fulfillment of conditions.

In the present embodiment, the plurality of patch images used in the sensing operation include a patch image formed at a development bias when a change in the image density of the patch image is saturated with respect to an increase in the development bias. Since density change rate k is computed after data (points PL5 to PL7) included within the saturated region are obtained, density change rate k can be calculated with high accuracy.

In the present embodiment, development bias Vb applied to the developer carrier at the time of image formation is determined from an appropriate value of anti-fogging potential difference V3, which is a difference between non-image portion potential V0 of photoconductor 1 and development bias Vb, based on the data of density change rate k obtained by changing development bias Vb. By performing setting in such a procedure, development bias conditions under which image formation can be performed at a high toner charging amount can be efficiently set.

To control the image formation conditions, another control from a different perspective may be performed after toner charging amount setting operation ST100 and development bias setting operation ST200 are performed. For example, development conditions may be set based on information of a solid patch image in the above operations ST100, ST200, and thereafter a patch image of a halftone image may be developed, and gradation properties (for example, intermediate gradation) in the halftone image may be fine-tuned by adjusting an exposure amount or the like. By additionally performing such a control, image formation conditions which allow implementation of image formation having higher quality can be set.

Embodiment 2

Referring to FIGS. 11 to 14, a wet-type image formation apparatus in Embodiment 2 will be described. In the wet-type image formation apparatus in accordance with the present embodiment, control unit 30 (FIG. 11) is provided with a control device 38 for controlling a motor for driving supply member 4B (FIG. 1). Control device 38 can change a rotation speed of supply member 4B by controlling a driver 39 for the drive motor for supply member 4B.

By providing a difference between a rotation speed of developer carrier 4C and the rotation speed of supply member 4B, the amount of the liquid developer (toner thin layer) conveyed to development portion 4D is increased or decreased. In the present embodiment, an image formation condition adjustment operation ST2000 (see FIG. 13) is performed, in which a conveying amount of the toner in the liquid developer conveyed to development portion 4D is also adjusted. Control device 38, driver 39, and supply member 4B serve as an adjustment unit adjusting the toner conveying amount.

In regard to the toner conveying amount conveyed to development portion 4D, that is, the amount of the liquid developer supplied from supply member 4B to developer carrier 4C, for example when a moving speed of the surface of supply member 4B is set faster than a moving speed of the surface of developer carrier 4C at a rotational contact portion between supply member 4B and developer carrier 4C, the amount of the liquid developer supplied to the rotational contact portion is increased, and a conveying amount of the liquid developer on developer carrier 4C is increased.

Control unit 30 adjusts the adjustment unit (control device 38, driver 39, and supply member 4B) based on an image density of a patch image sensed by optical sensor 5 (sensing unit), and thereby the conveying amount of the toner in the liquid developer conveyed to the development portion is adjusted. Other than this configuration, the toner conveying amount may be adjusted by adjusting a contact pressure force of restriction blade 4P with respect to draw-up member 4A, or an abutting position of restriction blade 4P with respect to draw-up member 4A, as means adjusting a supply amount of the liquid developer to developer carrier 4C. Other than this configuration, the toner conveying amount may be adjusted by applying a bias between draw-up member 4A and supply member 4B and utilizing a potential difference therebetween, or the toner conveying amount may be adjusted by applying a bias between supply member 4B and developer carrier 4C and utilizing a potential difference therebetween.

Generally, the surface roughness of the recording medium (printing object) changes with a change in the type of the recording medium. In the wet-type electrophotographic method, a toner amount required to obtain a desired density differs depending on the type of the recording medium. Even when the type of the recording medium is identical, the concentration of the liquid developer, the viscosity of the liquid developer, toner particle size distribution, and the like tend to vary depending on individual differences in manufacturing and a change in an ambient environment of the apparatus, and these parameters influence a toner conveying amount which allows implementation of high quality image formation. To allow implementation of high quality image formation even if these parameters vary, in the image formation condition adjustment operation ST2000 (see FIG. 13) in accordance with the present embodiment, adjustment of the toner conveying amount conveyed to development portion 4D is also performed in addition to adjustment of the toner charging amount and adjustment of the development bias.

Figure 12:
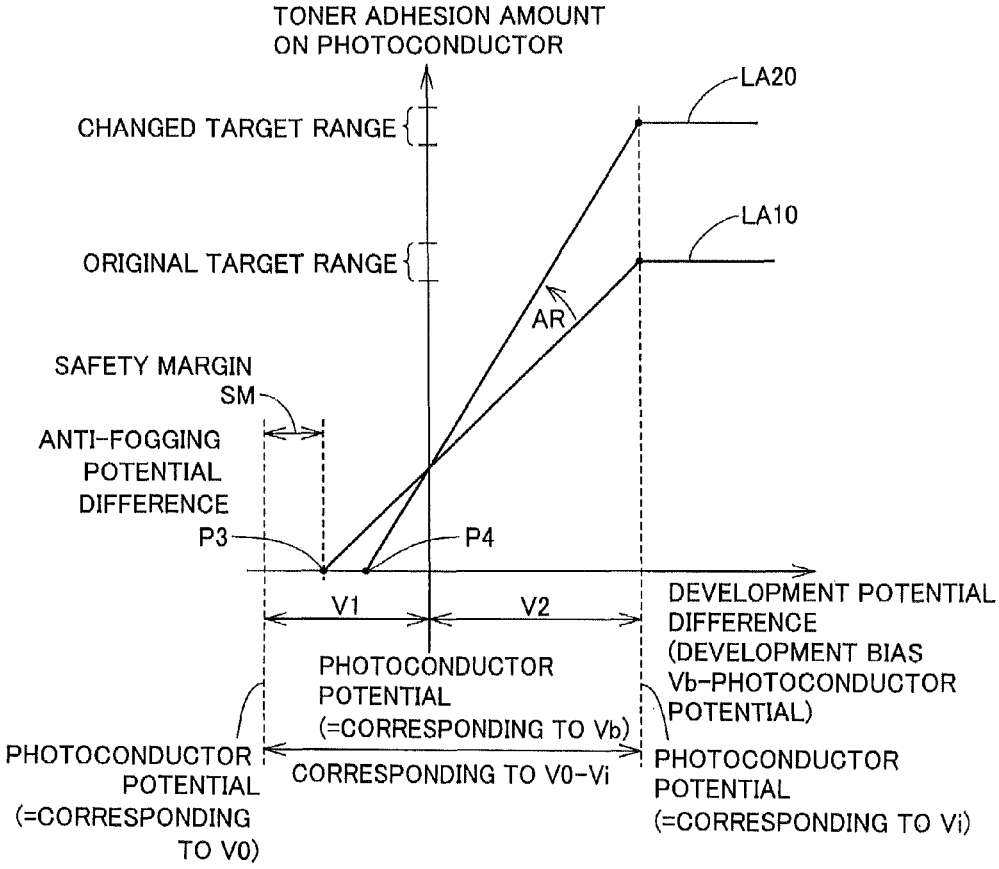
FIG. 12 is a view for explaining that a required toner conveying amount is increased, in regard to Embodiment 2.

Referring to FIG. 12, it is assumed that a required toner conveying amount is increased with a change in the type of the recording medium (printing object), for example. In this case, the target range of the toner adhesion amount on the photoconductor is also increased, and ideal development characteristics which allow implementation of high quality image formation are also changed. Lines LA10, LA20 in FIG. 12 indicate two different ideal development characteristics having different required toner adhesion amounts (target ranges).

When the required toner adhesion amount (target range) is changed, the gradient of the inclined portion of the development characteristics is also changed as indicated by an arrow AR. That is, the toner charging amount should be changed. When the required toner adhesion amount (target range) is changed, anti-fogging potential difference V3 is also changed from a position indicated by point P3 to a position indicated by a point P4. Development bias Vb should also be changed. Therefore, when the required toner conveying amount is changed with a change in the type of the recording medium (printing object) or the like, it is necessary to adjust the toner charging amount and the development bias based on the changed toner conveying amount.

In the present embodiment, the toner conveying amount is adjusted, and thereafter toner charging amount setting operation ST100 and development bias setting operation ST200 are performed as in Embodiment 1. When the target range of the toner adhesion amount is changed, required toner charging amount and development bias are also changed. That is, when the toner conveying amount is adjusted after the toner charging amount or the development bias is determined, the toner charging amount or the development bias should be adjusted again. Thus, the image formation conditions can be efficiently set by controlling the adjustment unit first to adjust the toner conveying amount and thereafter performing the toner charging amount setting operation and the development bias setting operation. Hereinafter, image formation condition adjustment operation ST2000 in the present embodiment will be specifically described.

Figure 13:
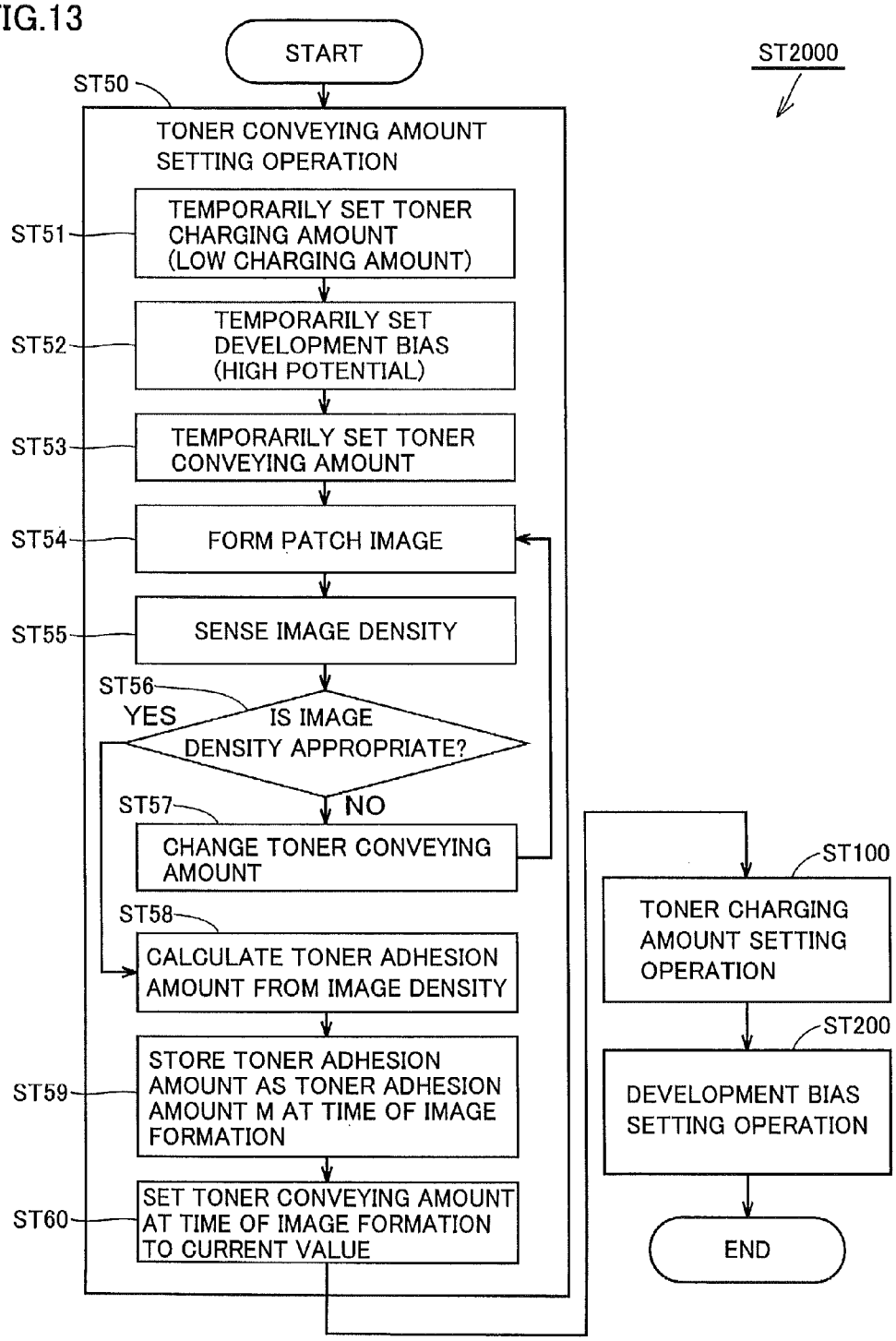
FIG. 13 is a flowchart illustrating an image formation condition adjustment operation performed by the wet-type image formation apparatus in Embodiment 2.

Referring to FIG. 13, image formation condition adjustment operation ST2000 includes a toner conveying amount setting operation ST50, toner charging amount setting operation ST100, and development bias setting operation ST200. First, toner conveying amount setting operation ST50 is performed. Toner conveying amount setting operation ST50 is performed for example when a sensor (not shown) senses a change in the type of the recording medium, and/or when a change in the type of the recording medium is input to operation panel 37 (FIG. 11) or the like.

(Toner Conveying Amount Setting Operation ST50)

Specifically, first, the toner charging amount is set to a temporary value (ST51). Although any value can be adopted as the temporary value of the toner charging amount, it is preferable to adopt a lower value within a range where patch development is possible which is experimentally acquired beforehand.

Figure 14:
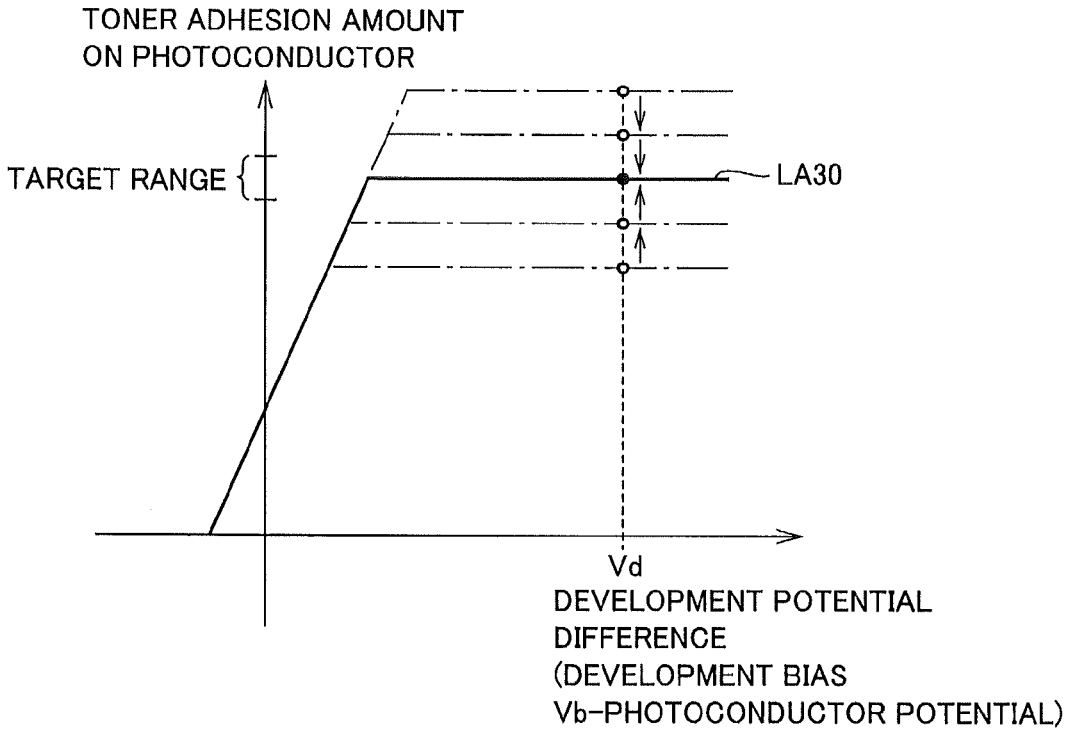
FIG. 14 is a view for explaining a toner conveying amount setting operation of the image formation condition adjustment operation performed by the wet-type image formation apparatus in Embodiment 2.

FIG. 14 shows presumed development characteristics LA30 (solid line) when toner conveying amount setting operation ST50 is performed, and development characteristics (dashed-dotted lines) at a certain time point when toner conveying amount setting operation ST50 is performed. White plots and a black plot in the drawing each indicate a toner adhesion amount calculated from a patch image. As can be seen from the positions to which the white plots and black plot are allotted, the gradient of an inclined portion of the presumed development characteristics is increased by setting the toner charging amount low, which facilitates evaluation of conditions based on the toner adhesion amount of the patch image (image density) at the time of saturated development.

Next, development bias Vb is also set to a temporary value (ST52). Although any value can be adopted as the temporary value of development bias Vb, it is preferable to adopt a higher value, considering the limitation of a leak at the development portion (nip portion) which is experimentally acquired beforehand, or the like. It is also desirable here to set the development bias as high as possible (on the right side of the axis of abscissas in the drawing) to facilitate evaluation of conditions based on the toner adhesion amount of the patch image (image density) at the time of saturated development.

Next, the toner conveying amount is also set to a temporary value (ST53). Although any value can be adopted as the temporary value of the toner conveying amount, it is preferable to adopt a value having a sufficiently small toner conveying amount, or a value having a sufficiently large toner conveying amount. As the temporary value of the toner conveying amount, a value adopted when previous image formation condition adjustment operation ST2000 was performed may be adopted, or an appropriate value that is experimentally predicted from the type of the recording medium input may be adopted.

Next, a patch image is formed (ST54). Specifically, a patch image is formed by driving the development device and the photoconductor, setting a potential of an electrostatic latent image for forming the patch image (a surface potential of the photoconductor) to image portion potential Vi, and applying development bias Vb set in step ST52 to the developer carrier. Next, an image density of the patch image is sensed using optical sensor 5 (ST55).

CPU 31 of control unit 30 (FIG. 11) reads data about a predetermined target density range prepared based on an experiment and the like performed beforehand, from memory 36, and determines whether or not the image density (saturated image density) of the patch image sensed by optical sensor 5 is included within this range (ST56).

When control unit 30 determines that the image density (saturated image density) of the patch image sensed by optical sensor 5 is not included within this range, control unit 30 changes the toner conveying amount (ST57). For example, when the image density of the patch image is deviated from the target range as indicated by the white plots in FIG. 14, control unit 30 changes the toner conveying amount to be decreased if the toner conveying amount is large, and changes the toner conveying amount to be increased if the toner conveying amount is small. Whether or not the image density is within the target range may be determined based on whether or not obtained data is less than or equal to ±δ% (where δ is an allowable value set taking errors and variations into account) with respect to a predetermined target value.

The toner conveying amount is optimized by repeating a series of steps ST51 to ST56. When it is determined that the image density of the patch image is appropriate (YES in step ST56), a toner amount is calculated from the result of the sensed image density. Calculated data is stored in memory 36 as toner adhesion amount M at the time of image formation (ST59). Information about toner adhesion amount M obtained in a state where the toner conveying amount is optimized is used in subsequent toner charging amount setting operation ST100. Finally, conditions for implementing the current toner conveying amount (for example, the rotation speed of supply member 4B) are set as toner supply conditions at the time of forming an ordinary image (ST60), and toner conveying amount setting operation ST50 is finished. Thereafter, toner charging amount setting operation ST100 and development bias setting operation ST200 are performed as in Embodiment 1.

(Function and Effect)

In the present embodiment, toner conveying amount setting operation ST50 is performed prior to toner charging amount setting operation ST100. Even when the required toner conveying amount is changed with a change in the type of the recording medium (printing object) or the like, it is possible to adjust the toner charging amount and the development bias to an optimal state, based on the changed toner conveying amount. That is, since a magnitude which can be used as the sum of a fogging margin and the development bias is determined first, and then the development bias is determined from the fogging margin, the development potential difference can be maximized and the toner charging amount can be maximized.

Embodiment 3

In image formation condition adjustment operation ST1000 (see FIG. 6) in accordance with Embodiment 1 described above, it is determined in step ST7 whether or not the image density is saturated. As described above, since density change rate k is computed after the data (points PL5 to PL7 in FIG. 7) included within the saturated region are obtained, density change rate k can be calculated with high accuracy. Determining whether or not the image density is saturated is not an essential component, and may be performed as necessary. A specific description will be given below.

Figure 15:
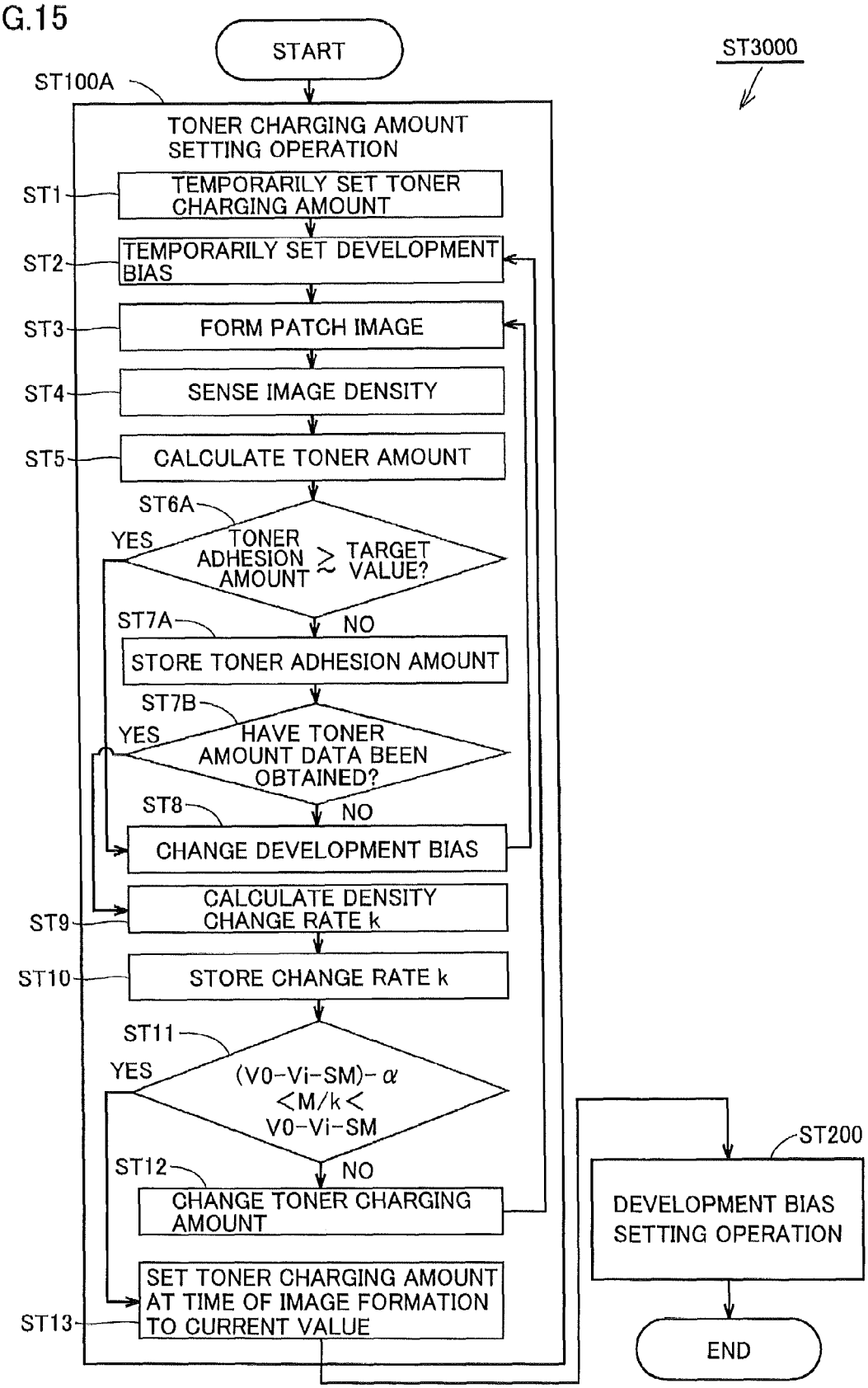
FIG. 15 is a flowchart illustrating an image formation condition adjustment operation performed by a wet-type image formation apparatus in Embodiment 3.

Referring to FIG. 15, in the present embodiment, an image formation condition adjustment operation ST3000 is performed. Image formation condition adjustment operation ST3000 includes a toner charging amount setting operation ST100A instead of toner charging amount setting operation ST100 (FIG. 6).

(Toner Charging Amount Setting Operation ST100A)

As in Embodiment 1, steps ST1 to ST5 are performed. Specifically, first, the toner charging amount is set to a temporary value (ST1), and development bias Vb is also set to a temporary value (ST2). A patch image is formed (ST3), an image density of the patch image is sensed using optical sensor 5 (ST4), and an adhesion amount of the toner is calculated based on the sensed result (ST5).

Next, in step ST6A, the adhesion amount of the toner adhering to the photoconductor, that is, the toner adhesion amount calculated in step ST5, is compared with a toner amount (target value) estimated from conditions for supplying the toner to the developer carrier, instead of determining whether or not the image density is saturated. It is determined whether or not the toner adhesion amount calculated in step ST5 is a value that can be used to calculate density change rate k.

Specifically, when the toner adhesion amount calculated in step ST5 is sufficiently smaller than the toner amount (target value) estimated from the toner supply conditions (NO in step ST6A), data about the toner adhesion amount is stored in memory 36 as data that can be used to calculate density change rate k. Determination as NO is made in step ST6A when, for example, the relation that the toner adhesion amount calculated in step ST5<(estimated toner amount×0.95) is satisfied. In this case, determining whether or not the image density is saturated as in Embodiment 1 is not performed.

On the other hand, when the toner adhesion amount calculated in step ST5 is close to the toner amount (target value) estimated from the toner supply conditions or is larger than the target value (YES in step ST6A), it is determined that the data cannot be used to calculate density change rate k. Determination as YES is made in step ST6A when, for example, the relation that the toner adhesion amount calculated in step ST5 ≥(estimated toner amount×0.95) is satisfied. In this case, the data about the toner adhesion amount is not stored in memory 36, and the development bias is changed to a smaller value (ST8). The processing returns to step ST3, and a patch image is formed again.

To adopt the configuration as in the present embodiment, it is necessary that the toner adhesion amount with respect to the toner supply conditions is stable. When such a stable supply mechanism is used, setting time can be shortened because there is no need to determine each time whether or not the image density is saturated. By setting a bias value when the development bias is set to the temporary value to be lower, the relation that the toner adhesion amount calculated in step ST5<estimated toner amount×0.95 can be readily satisfied, and the image formation conditions can be set more efficiently.

When it is determined as NO in step ST6A and the data of the toner adhesion amount is stored in memory 36 in step ST7A, it is determined in step ST7B whether or not a required number of the data of the toner adhesion amount have been obtained. Here, it is determined whether or not data enough to calculate density change rate k have been obtained. The threshold used herein is, for example, two, three, or the like. Density change rate k can be calculated more accurately when a larger value is set as the threshold. It is preferable to optimize the threshold considering time required to obtain the data.

Control unit 30 determines whether or not a predetermined number of data have been obtained, and if the data are not enough, control unit 30 repeats a flow of changing the development bias and returning to step ST3 to form a patch image again. When control unit 30 determines that the required number of data have been obtained, the processing proceeds to calculation of density change rate k (ST9).

Density change rate k corresponds to the gradient of the inclined portion of the development characteristics excluding the saturated region, and can be easily derived from the obtained data about a plurality of toner adhesion amounts. Data about calculated density change rate k is stored in memory 36 (ST10), as in Embodiment 1. Thereafter, it is determined whether or not density change rate k satisfies conditions under which the toner adhesion amount is set to be within the target range and the toner charging amount can be set to a value that is as high as possible while maintaining the toner adhesion amount within that target range (ST11), as in Embodiment 1. Control unit 30 controls toner charging device 4R to change the toner charging amount such that density change rate k is included within the effective change rate range. Also through a flow as described above, conditions under which the toner charging amount can be set to a value that is as high as possible can be efficiently set by calculating current density change rate k while changing development bias Vb, and optimizing the toner charging amount through computation.

Although the embodiments of the present invention have been described, it should be understood that the embodiments disclosed herein are illustrative and non-restrictive in every respect. The scope of the present invention is defined by the scope of the claims, and is intended to include any modifications within the scope and meaning equivalent to the scope of the claims.

What is claimed is:

1. A wet-type image formation apparatus forming an image on a recording medium, comprising:

an image carrier carrying an electrostatic latent image;

a developer carrier conveying a liquid developer to a development portion serving as a position facing said image carrier, to develop said electrostatic latent image and form a toner image;

a charging unit charging toner in said liquid developer conveyed to said development portion;

an application unit applying a development bias to said developer carrier;

a sensing unit sensing an image density of said toner image; and a control unit controlling said charging unit based on information about a set target range of development characteristics prepared beforehand, wherein a toner charging amount setting operation is performed when a toner charging amount for the toner in said liquid developer conveyed to said development portion is set, and said toner charging amount setting operation includes a sensing operation in which said sensing unit senses image densities of a plurality of patch images formed at different development biases with said toner charging amount being set to a constant value, and a setting operation in which, in a case where said control unit calculates current development characteristics based on the image densities of said plurality of patch images sensed by said sensing unit, and determines that said current development characteristics are not included within said set target range, said control unit controls said charging unit to set said toner charging amount such that the development characteristics are included within said set target range.

2. The wet-type image formation apparatus according to claim 1, wherein said set target range includes information about an effective change rate range, and said setting operation has an operation in which, in a case where said control unit calculates a change rate of the image density of the patch image when the image density is increased with respect to an increase in the development bias, as said current development characteristics, and determines that the calculated change rate of said image density is not included within said effective change rate range, said control unit controls said charging unit to set said toner charging amount such that the change rate of said image density is included within said effective change rate range.

3. The wet-type image formation apparatus according to claim 1, wherein said plurality of patch images used in said sensing operation include a patch image formed at a development bias when a change in the image density of the patch image is saturated with respect to an increase in the development bias.

4. The wet-type image formation apparatus according to claim 3, further comprising an adjustment unit adjusting a conveying amount of the toner in said liquid developer conveyed to said development portion, wherein, before said toner charging amount setting operation is performed, said control unit controls said adjustment unit to adjust said conveying amount such that an image density of the patch image formed at the development bias when the change in the image density of the patch image is saturated with respect to the increase in the development bias is within a predetermined target density range.

5. The wet-type image formation apparatus according to claim 4, wherein said control unit calculates an anti-fogging potential difference based on the development characteristics set in accordance with setting of said toner charging amount, and controls said application unit based on the anti-fogging potential difference to set the development bias.

6. The wet-type image formation apparatus according to claim 5, wherein said control unit first controls said adjustment unit to adjust said conveying amount, and then performs said toner charging amount setting operation and an operation of setting the development bias.

7. The wet-type image formation apparatus according to claim 5, wherein said control unit performs an operation of controlling said adjustment unit to adjust said conveying amount and said toner charging amount setting operation, and finally performs an operation of setting the development bias.

8. The wet-type image formation apparatus according to claim 5, wherein said control unit further adjusts gradation properties based on an image density of a halftone image formed with the development bias being set.

9. The wet-type image formation apparatus according to claim 1, wherein said control unit performs said toner charging amount setting operation when a change in type of said recording medium is sensed and/or when a change in type of said recording medium is input.

* * * * *